US009366006B2

(12) United States Patent
Morinaga et al.

(10) Patent No.: US 9,366,006 B2
(45) Date of Patent: Jun. 14, 2016

(54) BUCKET FOR WORK VEHICLE, AND WORK VEHICLE EQUIPPED WITH BUCKET WITH LEFT AND RIGHT BOOM ATTACHMENT PORTIONS

(71) Applicant: KOMATSU LTD., Tokyo (JP)

(72) Inventors: Hideo Morinaga, Komatsu (JP); Takao Tohriyama, Komatsu (JP)

(73) Assignee: KOMATSU LTD., Tokyo (JP)

( * ) Notice: Subject to any disclaimer, the term of this patent is extended or adjusted under 35 U.S.C. 154(b) by 97 days.

(21) Appl. No.: 14/397,726

(22) PCT Filed: Sep. 3, 2014

(86) PCT No.: PCT/JP2014/073206
§ 371 (c)(1),
(2) Date: Oct. 29, 2014

(87) PCT Pub. No.: WO2015/173976
PCT Pub. Date: Nov. 19, 2015

(65) Prior Publication Data
US 2016/0060841 A1 Mar. 3, 2016

(51) Int. Cl.
*E02F 3/40* (2006.01)
*E02F 3/34* (2006.01)

(52) U.S. Cl.
CPC .... *E02F 3/40* (2013.01); *E02F 3/34* (2013.01)

(58) Field of Classification Search
CPC ..... E02F 3/40; E02F 3/34
See application file for complete search history.

(56) References Cited

U.S. PATENT DOCUMENTS

| | | | | |
|---|---|---|---|---|
| 4,120,105 | A | 10/1978 | Stepe | |
| 4,523,397 | A | 6/1985 | Lucas | |
| 4,991,662 | A * | 2/1991 | Caron | E02F 3/815 172/701.1 |
| 5,392,864 | A * | 2/1995 | Lindenmuth | E02F 3/815 172/701.1 |
| D477,610 | S * | 7/2003 | Matsumoto | D15/11 |
| D478,098 | S * | 8/2003 | Matsumoto | D15/11 |
| 6,938,701 | B2 * | 9/2005 | Matsumoto | E02F 3/7618 172/811 |
| 7,083,002 | B2 * | 8/2006 | Matsumoto | E02F 3/7618 172/822 |
| D534,929 | S * | 1/2007 | Matsumoto | D15/32 |
| D538,307 | S * | 3/2007 | Matsumoto | D15/32 |
| 2007/0212207 | A1 | 9/2007 | Gust | |
| 2013/0045073 | A1 | 2/2013 | Bricker et al. | |

FOREIGN PATENT DOCUMENTS

| | | | |
|---|---|---|---|
| JP | 54-35002 | A | 3/1979 |
| JP | 54-35002 | U | 3/1979 |
| JP | 2001-32318 | A | 2/2001 |
| JP | 2001032318 | A * | 2/2001 |
| JP | 2002-48188 | A | 2/2002 |
| JP | 2002048188 | A * | 2/2002 |
| WO | 2015/006809 | A1 | 1/2015 |
| WO | WO 2015/006809 | * | 1/2015 |

OTHER PUBLICATIONS

The extended European search report for the corresponding European application No. 14783989.8, issued on Oct. 16, 2015.
The Office Action for the corresponding Japanese application No. 2014-555424, issued on Apr. 28, 2015.
The International Search Report for the corresponding international application No. PCT/JP2014/073206, issued on Jan. 6, 2015.

* cited by examiner

*Primary Examiner* — Gerald McClain
(74) *Attorney, Agent, or Firm* — Global IP Counselors, LLP

(57) ABSTRACT

A bucket for a work vehicle includes a bucket main body portion, left and right boom attachment portions, and a spill plate. The left and right boom attachment portions are adhered to the rear surface of a basal plate, to the left and right sides of the center of the basal plate in the lateral direction, respectively. The spill plate includes a first spill plate portion and a second spill plate portion. In a top view, the second spill plate portion includes a forward edge line extending in the left and right directions from a center of the bucket main body portion in the lateral direction, and first left and right edge lines extending to first and second connection points rearward and leftward and rightward from first and second front ends, which are the left and right ends of the forward edge line, respectively. In a top view, the first spill plate portion includes a second left edge line, a second right edge line, a third left edge line, and a third right edge line.

20 Claims, 12 Drawing Sheets

BUCKET FOR WORK VEHICLE, AND WORK VEHICLE EQUIPPED WITH BUCKET WITH LEFT AND RIGHT BOOM ATTACHMENT PORTIONS

CROSS-REFERENCE TO RELATED APPLICATIONS

This application is a U.S. National stage application of International Application No. PCT/JP2014/073206, filed on Sep. 3, 2014.

BACKGROUND

1. Field of the Invention

The present invention relates to a bucket for a work vehicle, and to a work vehicle equipped with such a bucket.

2. Background Art

Japanese Laid-Open Patent Publication 2001-32318 discloses a spill guard that reduces spillover of the bucket load, while still ensuring the visibility of its upper end portions while the vehicle is traveling. The shape of this spill guard is determined in the following manner. First the points of intersection between a surface defining the spill guard and a line connecting the upper end portions and a point of view (an eye point) that is determined in advance. The shape of the spill guard is determined so that at least these points of intersection are cut out.

The objective of the design of the spill guard according to Japanese Laid-Open Patent Publication 2001-32318 is to secure the visibility of at least the end portion of the bucket during traveling of the vehicle, i.e. in the state that the boom is lowered, as well as to reduce, to the greatest possible extent, spillover of the bucket load, in which portions of the load stuff in the bucket fall down from the bucket. Accordingly, the spill guard is designed to be cut out as little as possible, except for its end portions.

However, it is not sufficient only to secure the visibility of the end portions of the bucket. For example, because the bucket is held up to be higher than the cab when the work vehicle loads the load stuff into a truck, it is desirable for the spill guard to be cut out to such an extent that it is possible visually to check the load stuff in the bucket even when the bucket is thus being held up. In other words, it is desirable for it to be cut out to the extent that it is also possible visually to check the portions of the bucket that are nearer to its center. However, there is no investigation related to this type of problem in Japanese Laid-Open Patent Publication 2001-32318.

Moreover, when the spill guard is cut out to such an extent that it is possible visually to check the load stuff in the bucket even when the bucket is raised up, then, when a great deal of stuff is loaded into the bucket, some portion of this load stuff may fall down from the bucket. However it is not desirable for the load stuff to fall down upon the couplings of the left and right booms and the tilt rod that support the bucket, because it deteriorates the rotation performance of these couplings. Moreover, when the cutout in the spill guard is large, then it becomes highly possible that the load stuff falling down from the bucket may slide along the boom and collide with the front glass of the cab, and thereby damage the front glass.

SUMMARY

The object of the present invention is to provide a bucket for a work vehicle to secure the visibility of the bucket as well as to be able to protect the couplings of the left and right booms that support the bucket, and also the front glass of the cab, from load stuff falling down from the bucket, and also to provide a work vehicle equipped with such a bucket.

According to a first aspect of the present invention, a bucket for a work vehicle comprises a bucket main body portion, a left boom attachment portion, a right boom attachment portion, and a spill plate. The bucket main body portion includes a basal plate having a curved shape, and a left side plate and a right side plate that are adhered to the basal plate. The left boom attachment portion is adhered to the rear surface of the basal plate, to the left side of the center of the basal plate in the lateral direction. The right boom attachment portion is adhered to the rear surface of the basal plate, to the right side of the center of the basal plate in the lateral direction. The spill plate includes a first spill plate portion connected to the upper edge of the bucket main body portion, and a second spill plate portion connected to the front edge of the first spill plate portion.

In a top view, the second spill plate portion includes a forward edge line extending in the left and right directions from a center of the bucket main body portion in the lateral direction, a first left edge line extending rearward and leftward to a first connection point from a first front end, the first front end being a left end of the forward edge line, and a first right edge line extending rearward and rightward to a second connection point from a second front end, the second front end being a right end of the forward edge line.

In a top view, the first spill plate portion includes a second left edge line, a second right edge line, a third left edge line, and a third right edge line. The second left edge line is connected to the first left edge line at the first connection point, extends rearward and leftward, or leftward, from the first connection point to a third connection point, and inclines more forward than the first left edge line. The second right edge line is connected to the first right edge line at the second connection point, extends rearward and rightward, or rightward, from the second connection point to a fourth connection point, and inclines more forward than the first right edge line. The third left edge line is connected to the second left edge line at the third connection point, extends rearward and leftward from the third connection point, and inclines more rearward than the second left edge line. And the third right edge line is connected to the second right edge line at the fourth connection point, extends rearward and rightward from the fourth connection point, and inclines more rearward than the second right edge line. The first connection point is positioned to the left side of a first right end position, which is the right end position of the left boom attachment portion. And the second connection point is positioned to the right side of a first left end position, which is the left end position of the right boom attachment portion.

The first connection point may be positioned to the left side of the center position in the lateral direction of the left boom attachment portion. And the second connection point may be positioned to the right side of the center position in the lateral direction of the right boom attachment portion.

The first front end may be positioned to the left side of the first right end position. And the second front end may be positioned to the right side of the first left end position.

At least a part of the first left edge line may be positioned to the left side of the first right end position, and moreover to the right side of a second left end position, the second left end position being a left end position of the left boom attachment portion. At least a part of the first right edge line may be positioned to the right side of the first left end position, and moreover to the left side of a second right end position, the second right end position being a right end position of the right boom attachment portion.

The first front end may be positioned to the right side of the second left end position. The second front end may be positioned to the left side of the second right end position.

The first front end may be positioned to the right side of the center position of the left boom attachment portion in the lateral direction. The second front end may be positioned to the left side of the center position of the right boom attachment portion in the lateral direction.

This bucket for a work vehicle may further comprise a first side guard and a second side guard, the first side guard and the second side guard being adhered to the spill plate. As seen from the rear, the first connection point may be overlapped over the first side guard. Moreover, as seen from the rear, the second connection point may be overlapped over the second side guard.

In a top view, the first side guard may extend rearward and leftward from the front edge of the first side guard. In a top view, the second side guard may extend rearward and rightward from the front edge of the second side guard.

In a top view, the front edge of the first side guard may be positioned to the right side of the center position of the left boom attachment portion in the lateral direction. In a top view, the front edge of the second side guard may be positioned to the left side of the center position of the right boom attachment portion in the lateral direction.

In a top view, the front edge of the first side guard and the front edge of the second side guard may be positioned between the first front end and the second front end in the lateral direction.

The rear edge of the first side guard may be positioned to the left side of a second left end position, the second left end position being a left end position of the left boom attachment portion. The rear edge of the second side guard may be positioned to the right side of a second right end position, the second right end position being a right end position of the right boom attachment portion.

The first side guard may include a first fixing hole for attachment of a hoisting hook. This first fixing hole may be positioned to the left side of the second left end position.

The second side guard may include a second fixing hole for attachment of a hoisting hook. This second fixing hole may be positioned to the right side of the second right end position.

The spill plate may be bent along the forward side surface and the bottom surface of the first side guard and along the forward side surface and the bottom surface of the second side guard.

The spill plate may be formed from a single plate.

In a top view, the second left edge line and the second right edge line may be straight lines extending in the lateral direction.

The first left edge line, the first right edge line, the third left edge line, and the third right edge line may be straight lines.

According to a second aspect of the present invention, a work vehicle comprises a bucket for the work vehicle as described above, a left boom and a right boom, a first hydraulic cylinder, a second hydraulic cylinder, and a cab. The left boom and the right boom are fitted to the bucket for the work vehicle. The first hydraulic cylinder controls the left boom. The second hydraulic cylinder controls the right boom. The cab is disposed behind the left boom and the right boom. A front glass is provided in a front surface of the cab. The length between the first front end and the second front end in the lateral direction is longer than the length of the bottom edge of the front glass in the lateral direction.

According to the present invention, it is possible to protect the couplings of the left and right booms that support the bucket from load stuff falling down from the bucket, while still securing the visibility of the bucket.

DESCRIPTION OF EXEMPLARY EMBODIMENTS

First Exemplary Embodiment

Figure 1:
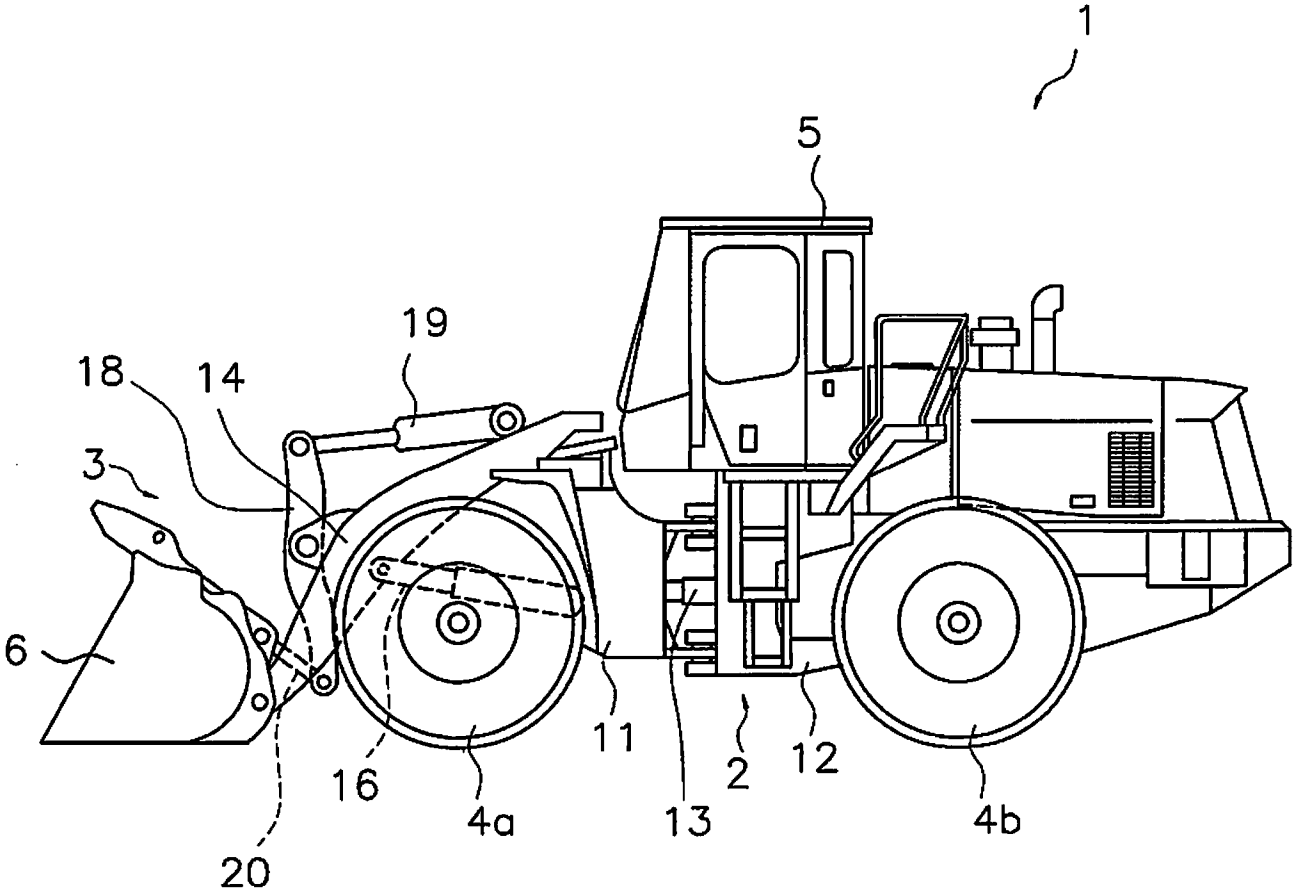
FIG. 1 is a side view of a work vehicle according to an exemplary embodiment.
Figure 2:
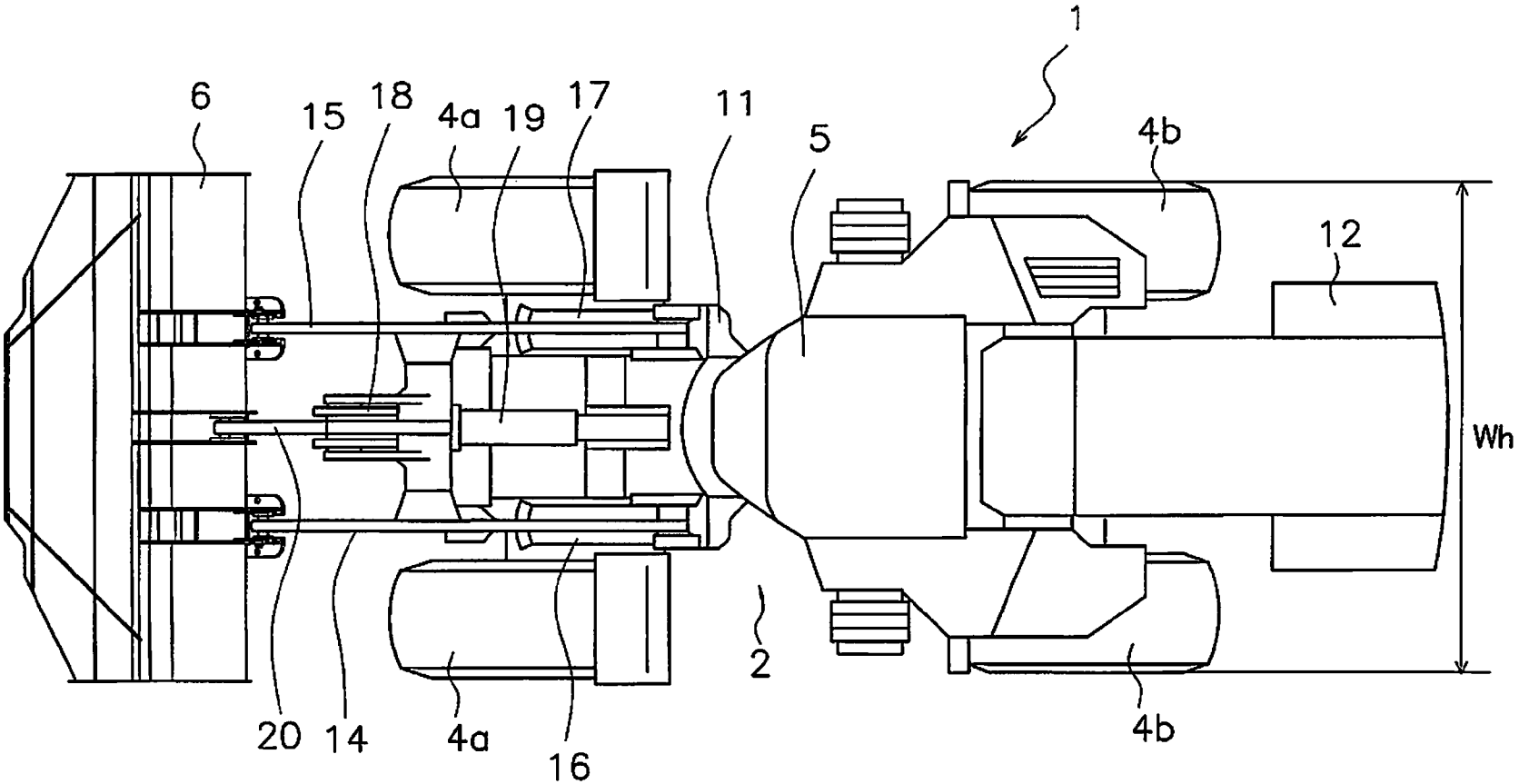
FIG. 2 is a top view of a work vehicle according to the exemplary embodiment.

Exemplary embodiments of the present invention will now be described with reference to the drawings. The structure of a work vehicle 1 according to an exemplary embodiment of the present invention will be described with reference to FIGS. 1 and 2. Here, although FIGS. 1 and 2 show a wheel loader as the work vehicle 1, the work vehicle could also be a work vehicle of some other type, such as a bulldozer or a hydraulic shovel or the like, which use the bucket. In the following explanation, "forward" means to the front of the vehicle, while "rearward" means to the rear of the vehicle. Moreover, "leftward" and "rightward" respectively mean to the left and to the right when facing to the front of the vehicle. Yet further, "upward" and "downward" respectively mean in the upward direction and in the downward direction with respect to the vehicle. In the following description, there are also sections that describe the positional relationships of the various portions constituting the bucket. In the description, "forward", "rearward", "leftward", "rightward", "upward", and "downward" mean "forward", "rearward", "leftward", "rightward", "upward", and "downward" in the state in which a bucket is attached to the work vehicle 1, and the bucket is grounded. Moreover, "positioned to the left side of the point A" and "positioned to the right side of the point C" mean "positioned on the left side with respect to a virtual plane passing through the point A that is perpendicular to the lateral (left-right) direction" and "positioned on the right side with respect to a virtual plane passing through the point C that is perpendicular to the lateral direction".

The work vehicle 1 comprises a vehicle body frame 2, a working implement 3, driving wheels 4*a* and 4*b*, and a cab 5. The work vehicle 1 can propel itself by rotating the driving wheels 4*a* and 4*b*, and perform a desired work with the working implement 3.

The vehicle body frame 2 comprises a front frame 11 and a rear frame 12. The front frame 11 and the rear frame 12 are attached together to be able to swing in the lateral direction. A steering cylinder 13 is attached to the front frame 11 and to the rear frame 12. The steering cylinder 13 is a hydraulic cylinder. The steering cylinder extends and retracts due to supply of hydraulic fluid from a steering pump (not shown in the drawings) to change the traveling direction of the work vehicle 1 from left and to right vice versa.

A working implement 3 and driving wheels 4*a* are attached to the front frame 11. The working implement 3 comprises a left boom 14, a right boom 15, and a bucket 6. The base end portion of the left boom 14 and the base end portion of the right boom 15 are swingably attached to the front frame 11. The bucket 6 is swingably attached to the end portion of the left boom 14 and to the end portion of the right boom 15. The front frame 11 and the left boom 14 are coupled by a left boom cylinder 17. Moreover, the front frame 11 and the right boom 15 are coupled by a right boom cylinder 17. The boom cylinders 16 and 17 are hydraulic cylinders. The boom cylinders 16 and 17 extend and retract due to supply of hydraulic fluid from the working implement pump (not shown in the drawings) to rotate the booms 14 and 15 to be raised and lowered. The boom cylinders 16 and 17 control the booms 14 and 15.

Furthermore, the working implement 3 also comprises a tilt arm 18, a bucket cylinder 19, and a tilt rod 20. The tilt arm 18 is swingably supported by the left boom 14 and the right boom 15 in the proximity of the center of the left boom 14 and the right boom 15. The bucket cylinder 19 is connected to the base end portion of the tilt arm 18 and to the front frame 11. The tilt rod 18 is connected to the end portion of the tilt arm 18 and to the bucket 6. The bucket cylinder 19 is a hydraulic cylinder. The bucket cylinder 19 extends and retracts due to supply of hydraulic fluid from a working implement pump (not shown in the drawings) to rotate the bucket 6 upward and downward. The bucket cylinder 19 controls the orientation of the opening area of the bucket 6.

Figure 9:
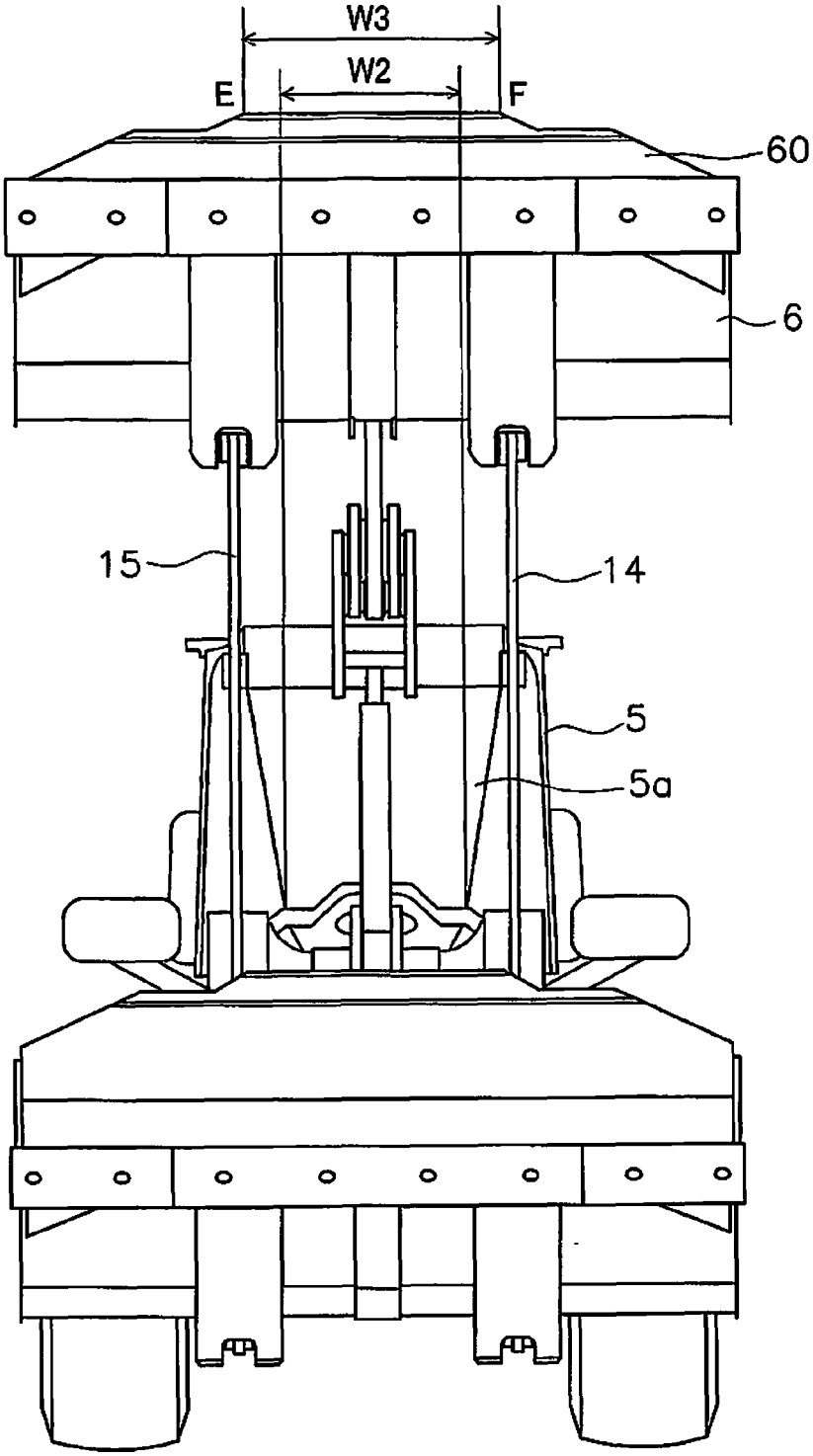
FIG. 9 is a front view of the work vehicle with the bucket raised.

A cab 5 and traveling wheels 4*b* are attached to the rear frame 12. The cab 5 is disposed behind the booms 14 and 15. The cab 5 is mounted upon the vehicle body frame 2. A seat upon which the operator sits and control equipment and so on are disposed within the cab 5. As shown in FIG. 9, a front glass 5*a* is provided in the front surface of the cab 5.

Figure 3:
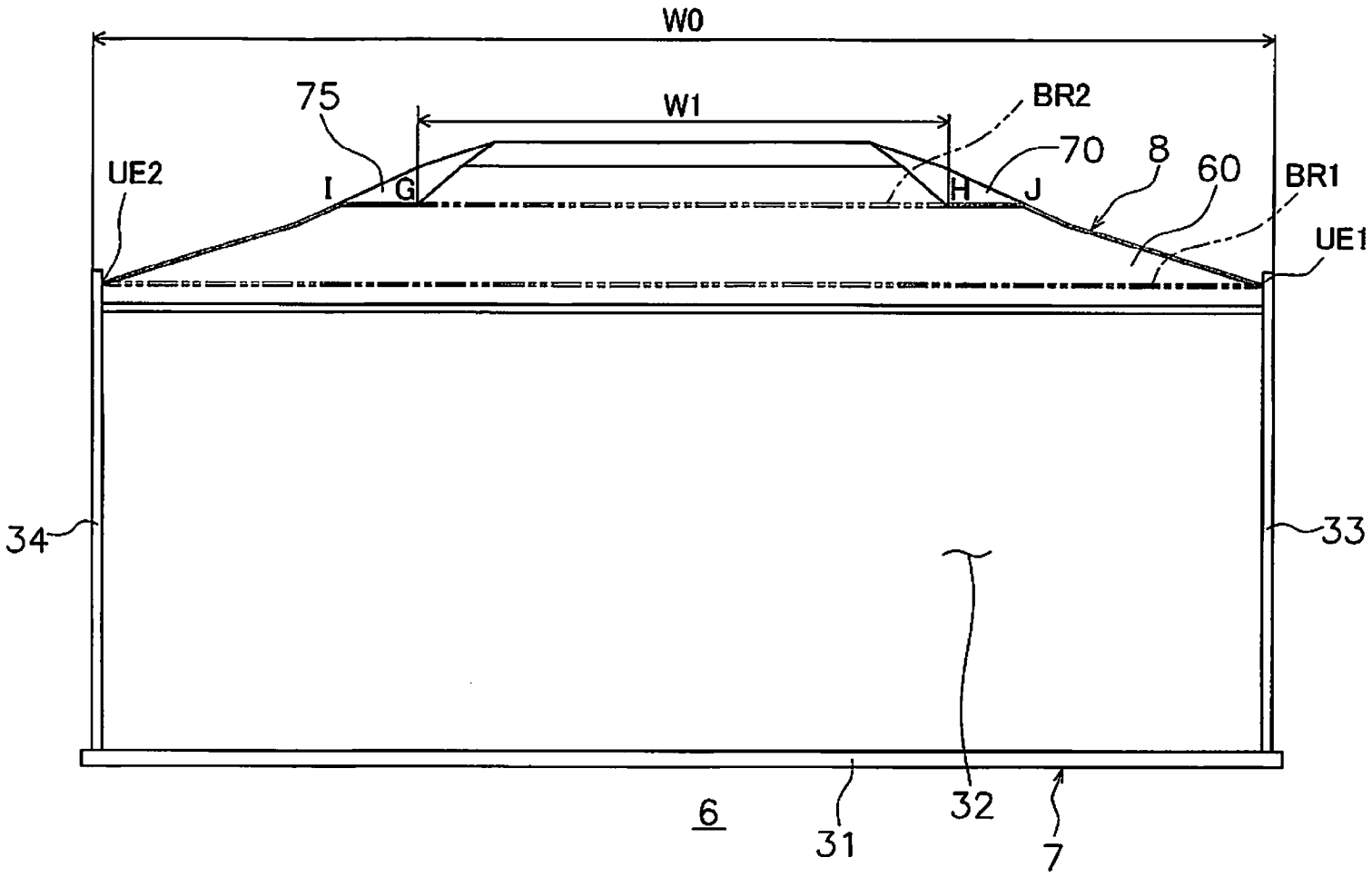
FIG. 3 is a front view of a bucket according to a first exemplary embodiment.
Figure 4:
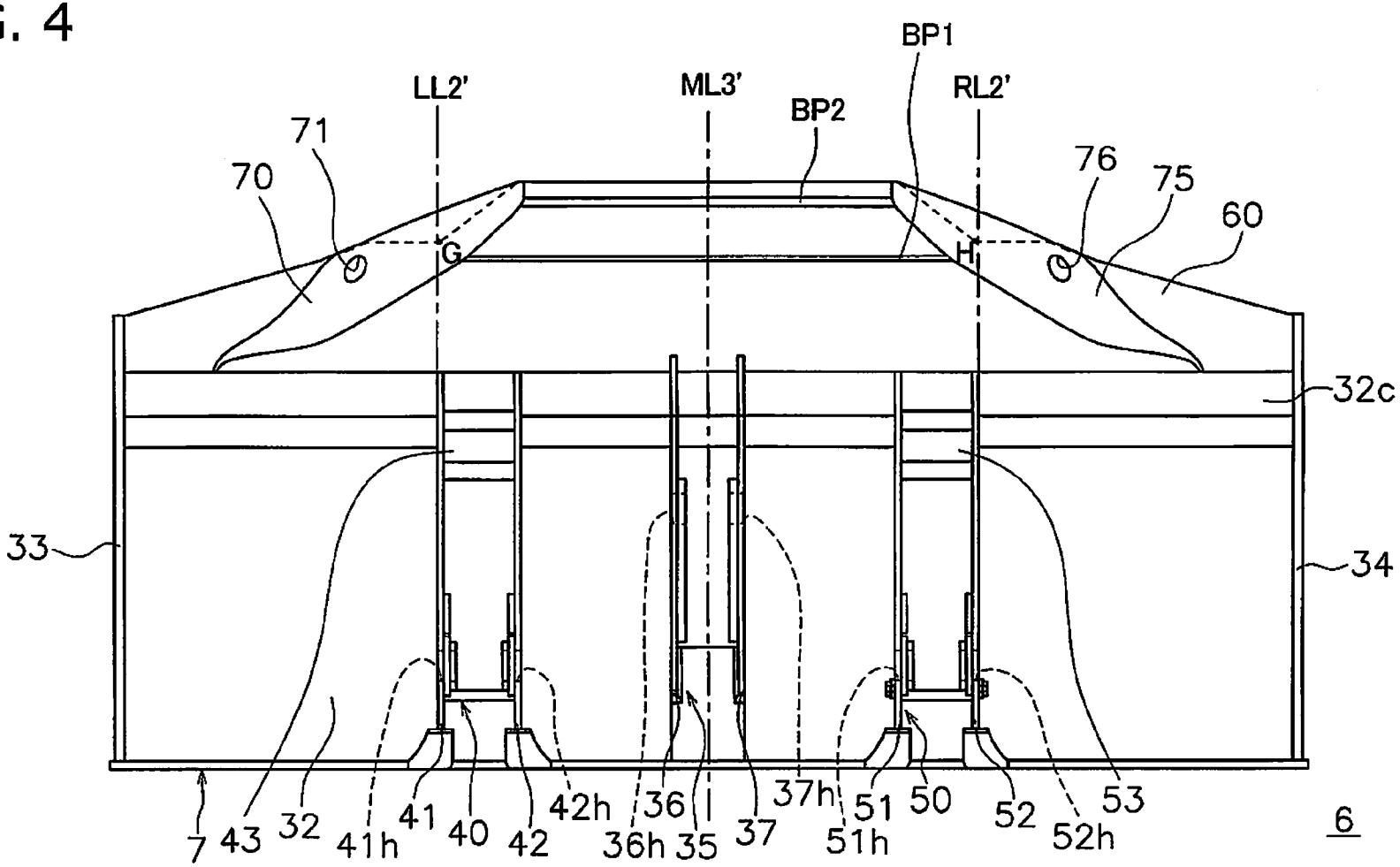
FIG. 4 is a rear view of the bucket according to the first exemplary embodiment.
Figure 5:
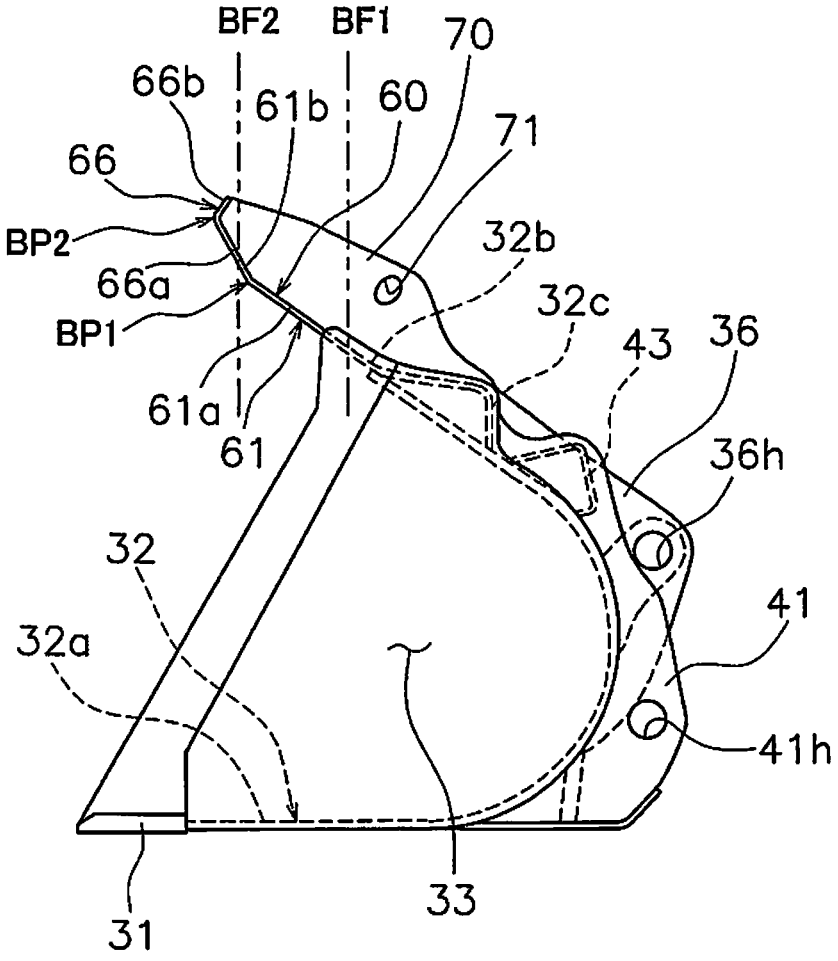
FIG. 5 is a left side view of the bucket according to the first exemplary embodiment.
Figure 6:
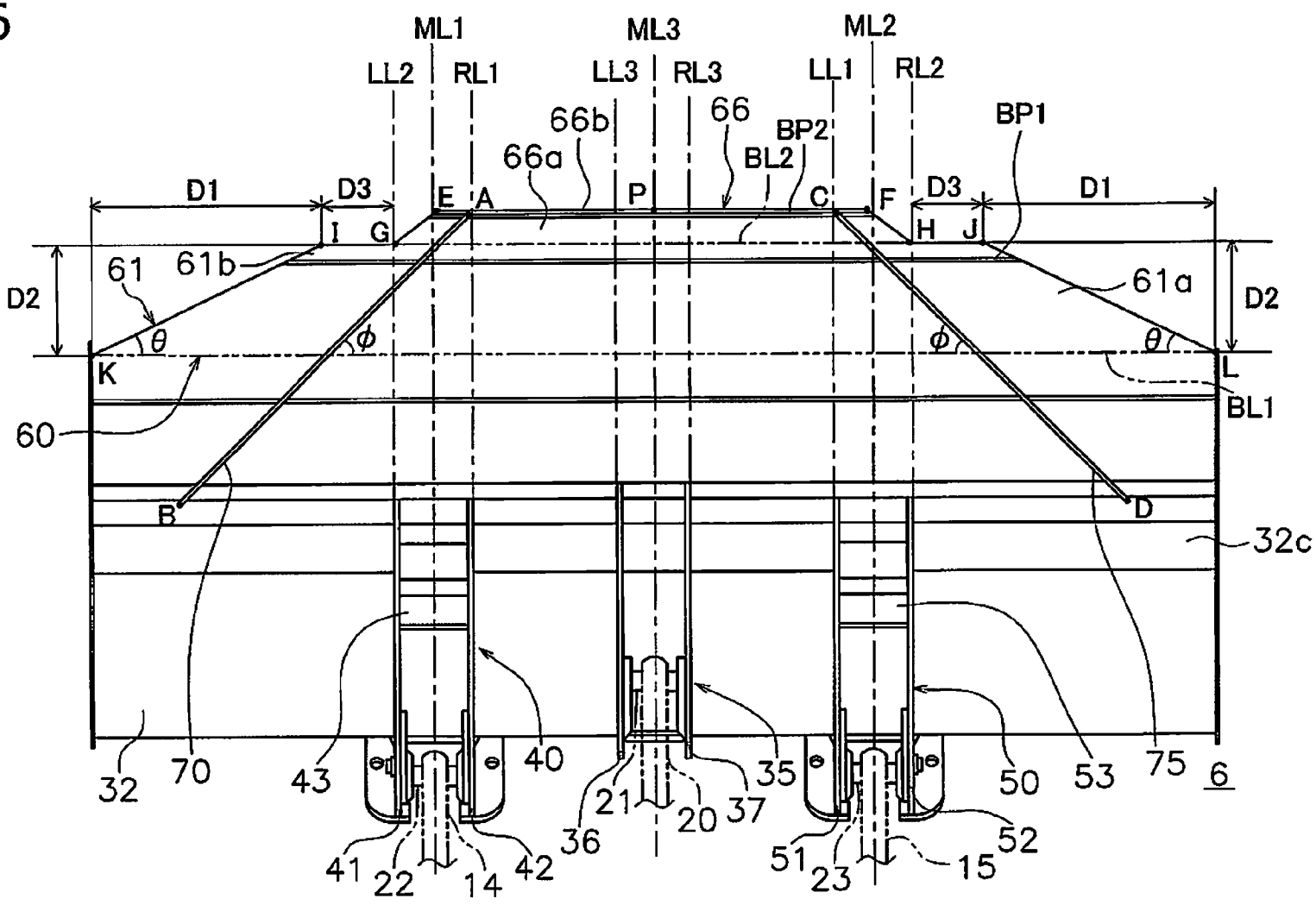
FIG. 6 is a top view of the bucket according to the first exemplary embodiment.

Next, the structure of the bucket 6 according to the first exemplary embodiment will be explained with reference to FIGS. 3 through 6. FIG. 3 is a front view of the bucket 6. And FIG. 4 is a rear view of the bucket 6. Moreover, FIG. 5 is a left side view of the bucket 6. Finally, FIG. 6 is a top view of the bucket 6.

Referring to FIGS. 3 through 5, the bucket 6 includes a bucket main body portion 7 and a spill guard 8. The bucket main portion 7 includes a cutting edge 31, a basal plate 32, a left side plate 33, a right side plate 34, a tilt rod attachment portion 35, a left boom attachment portion 40, and a right boom attachment portion 50. The spill guard 8 obstructs the fall of load stuff loaded in the bucket 6. The spill guard 8 includes a spill plate 60, a first side guard 70, and a second side guard 75.

The cutting edge 31 is for digging into earth or sand or the like which is to be loaded into the bucket 6. The cutting edge 31 is a plate shaped member provided with the edge at the bottom of the basal plate 32, and, as shown in FIG. 5, has a wedge form cross sectional shape that becomes thinner toward the edge. The basal plate 32 has a shape that curves in the form of a letter "C" from the cutting edge 31 to the first side guard 70 which will be described hereinafter. The basal plate 32 includes a lower member portion 32*a* and an upper member portion 32*b*. The lower member portion 32*a* is a plate shaped member having a curved shape. The upper member portion 32*b* is a plate shaped member that is adhered on the lower member portion 32*a*. As shown in FIGS. 4 through 6, the upper member portion 32*b* includes a rib 32*c* that is formed by bending the plate shaped member almost at a right angle.

The basal plate 32 is adhered to the left side plate 33 and to the right side plate 34. The left side plate 33 is a flat member that is adhered to the left side of the basal plate 32. The right side plate 34 is a flat member that is adhered to the right side of the basal plate 32. Thus, a box construction is formed by the basal plate 32 and the side plates 33 and 34. Load stuff, such as earth and sand and so on, is contained in this box construction. As shown in FIG. 3, the opening of the box construction formed by the basal plate 32 and the side plates 33 and 34 has an approximately rectangular shape. It is desirable for the horizontal width W0 of the bucket shown in FIG. 3 to be greater than the distance Wh between the outer sides of the left and right vehicle wheels 4*a* and 4*b* of the work vehicle 1 shown in FIG. 2. It should be understood that, if the work vehicle 1 is equipped with tracks instead of with the wheels 4*a* and 4*b*, then it is desirable for the horizontal width W0 of the bucket to be greater than the distance between the outer edges of the left and right tracks.

Referring to FIG. 4, the tilt rod attachment portion 35 is adhered to the basal plate 32 at the center thereof in the lateral direction. This tilt rod attachment portion 35 includes a first left side plate 36 and a first right side plate 37. The first left side plate 36 and the first right side plate 37 are flat members that extend in the vertical direction. As shown in FIGS. 5 and 6, the first left side plate 36 and the first right side plate 37 extend forward along the curved basal plate 32 toward the upper edge. As shown in FIGS. 4 and 5, the first left side plate 36 and the first right side plate 37 have respective rotation shaft fitting holes 36*h* and 37*h* for rotatably supporting a rotation shaft 21 of the tilt rod 20. The tilt rod 20 is attached to the tilt rod attachment portion 35 by the rotation shaft 21 being fitted in the rotation shaft fitting holes 36*h* and 37*h*, as shown by the two-dot chain line in FIG. 6. The position of the left side of the first left side plate 36 corresponds to the left end position of the coupling connecting the tilt rod 20 to the tilt rod attachment portion 35 when the tilt rod 20 is fitted to the tilt rod attachment portion 35. This left end position is termed a "third left end position". In FIG. 6, a phantom line passing through the third left end position and extending in the longitudinal (front-back) direction is shown by the chain line LL3. Moreover, the position of the right side of the first right side plate 37 corresponds to the right end position of the coupling connecting the tilt rod 20 to the tilt rod attachment portion 35 when the tilt rod 20 is fitted to the tilt rod attachment portion 35. The right end position is termed a "third right end position". In FIG. 6, a phantom line passing through the third right end position and extending in the longitudinal direction is shown by the chain line RL3. Moreover, in FIG. 6, a phantom line passing through the center position of the tilt rod 20 in the lateral direction when the tilt rod 20 is fitted to the tilt rod attachment portion 35, the phantom line extending in the longitudinal direction is shown by the chain line ML3. This phantom line ML3 corresponds to the center position of the tilt rod attachment portion 35 in the lateral direction. This phantom line ML3 passes precisely in the middle between the phantom line LL3 and the phantom line RL3. In FIG. 4, a phantom line passing through the center position of the tilt rod attachment portion 35 in the lateral direction, extending therefrom in the vertical direction is shown by the chain line ML3'. The bucket 6 is bilaterally symmetric with respect to a plane that contains both the chain line ML3 and the chain line ML3'.

Referring to FIG. 4, the left boom attachment portion 40 is adhered to the basal plate 32. The left boom attachment portion 40 is disposed to the left side of the tilt rod attachment portion 35. The left boom attachment portion 40 is adhered to the rear surface of the basal plate 32, to the left side of the center ML3' of the basal plate 32 in the lateral direction. The left boom attachment portion 40 includes a second left side plate 41 and a second right side plate 42. The second left side plate 41 and the second right side plate 42 are flat members that extend in the vertical direction. As shown in FIGS. 5 and 6, the second left side plate 41 and the second right side plate 42 extend forward along the curved basal plate 32 toward the upper side. Referring to FIGS. 4 and 6, a rib 43 is provided at the upper portion of the left boom attachment portion 40. Specifically, the rib 43 is provided above rotation shaft fitting holes 41*h* and 42*h*, which will be described below. The rib 43 is adhered to the second left side plate 41 and to the second right side plate 42.

As shown in FIGS. 4 through 6, the second left side plate 41 and the second right side plate 42 have respective rotation shaft fitting holes 41*h* and 42*h* for rotatably supporting a rotation shaft 22 of the left boom 14. As shown by the two-dot chain lines in FIG. 6, the left boom 14 is fitted to the left boom attachment portion 40 by the rotation shaft 22 being fitted into the rotation shaft fitting holes 41*h* and 42*h*. The left boom 14 is thereby attached to the bucket 6. The position of the left side of the second left side plate 41 corresponds to the left end position of the coupling connecting the left boom 14 to the left boom attachment portion 40 when the left boom 14 is fitted to the left boom attachment portion 40. This left end position is termed a "second left end position". In FIG. 6, a phantom line passing through the second left end position and extending in the longitudinal direction is shown by the chain line LL2. In FIG. 4, a phantom line passing through the second left end position and extending therefrom in the vertical direction is shown by the chain line LL2'. Moreover, the position of the right side of the second right side plate 42 corresponds to the right end position of the coupling connecting the left boom 14 to the left boom attachment portion 40 when the left boom 14 is fitted to the left boom attachment portion 40. This right end position is termed a "first right end position". In FIG. 6, a phantom line passing through the first right end position and extending in the longitudinal direction is shown by the chain line RL1. Moreover, in FIG. 6, a phantom line passing through the center position of the left boom 14 in the lateral direction when the left boom 14 is fitted to the left boom attachment portion 40, the phantom line extending therefrom in the longitudinal direction is shown by the chain line ML1. The phantom line ML1 passes precisely in the middle between the phantom line LL2 and the phantom line RL1. The phantom line ML1 corresponds to the center position of the left boom attachment portion 40 in the lateral direction.

Referring to FIG. 4, the right boom attachment portion 50 is adhered to the basal plate 32. The right boom attachment portion 50 is disposed to the right side of the tilt rod attachment portion 35. The right boom attachment portion 50 is adhered to the rear surface of the basal plate 32, to the right side of the center ML3' of the basal plate 32 in the lateral direction. The right boom attachment portion 50 includes a third left side plate 51 and a third right side plate 52. The third left side plate 51 and the third right side plate 52 are flat members that extend in the vertical direction. As shown in FIGS. 5 and 6, the third left side plate 51 and the third right side plate 52 extend forward along the curved basal plate 32 toward the upper side. Referring to FIGS. 4 and 6, a rib 53 is provided at the upper portion of the right boom attachment portion 50. Specifically, the rib 53 is provided above rotation shaft fitting holes 51*h* and 52*h*, which will be described below. The rib 53 is adhered to the third left side plate 51 and to the third right side plate 52.

As shown in FIGS. 4 through 6, the third left side plate 51 and the third right side plate 52 have respective rotation shaft fitting holes 51*h* and 52*h* for rotatably supporting a rotation shaft 23 of the right boom 15. As shown by the two-dot chain lines in FIG. 6, the right boom 15 is fitted to the right boom attachment portion 50 by the rotation shaft 23 being fitted into the rotation shaft fitting holes 51*h* and 52*h*. The right boom 15 is thereby attached to the bucket 6. The position of the left side of the third left side plate 51 corresponds to the left end position of the coupling connecting the right boom 15 to the right boom attachment portion 50 when the right boom 15 is fitted to the right boom attachment portion 50. This left end position is termed a "first left end position". In FIG. 6, a phantom line passing through the first left end position and extending in the longitudinal direction is shown by the chain line LL1. Moreover, the position of the right side of the third right side plate 52 corresponds to the right end position of the coupling connecting the right boom 15 to the right boom attachment portion 50 when the right boom 15 is fitted to the right boom attachment portion 50. This right end position is termed a "second right end position". In FIG. 6, a phantom line passing through the second right end position and extending in the longitudinal direction is shown by the chain line RL2. In FIG. 4, a phantom line passing through the second right end position and extending therefrom in the vertical direction is shown by the chain line RL2'. Moreover, in FIG. 6, a phantom line passing through the center position of the right boom 15 in the lateral direction when the right boom 15 is fitted to the right boom attachment portion 50, the phantom line extending in the longitudinal direction is shown by the chain line ML2. The phantom line ML2 passes precisely in the middle between the phantom line LL1 and the phantom line RL2. The phantom line ML2 corresponds to the center position of the right boom attachment portion 50 in the lateral direction.

The spill plate 60 is connected to the upper edge of the bucket main body portion 7. As shown in FIG. 3, the upper edge of the bucket main body portion 7 is defined by a first region boundary BR1 connecting between a first upper edge UE1 that is the upper edge of the portion where the basal plate 32 contacts the left side plate 33 and a second upper edge UE2 that is the upper edge of the portion where the basal plate 32 contacts the right side plate 34. Because the spill plate 60 and the upper member portion 32*b* of the bucket main body portion 7 are formed from the same single plate, it is not possible to check this first region boundary BR1 from the exterior. Thus, the first region boundary BR1 is shown by the phantom lines that mark the entire upper edge of the bucket main body portion 7. Specifically, this first region boundary BR1 has a rectangular shape. In FIG. 3, each of the upper edge and the lower edge of the first region boundary BR1 is shown by a two-dot chain line. These two two-dot chain lines are separated only by the thickness of the basal plate 32. In FIG. 5, the first region boundary BR1 is shown as a boundary line BF1. In FIG. 6, the first region boundary BR1 is shown as a first region boundary line BL1. In other words, the first region boundary line BL1 indicates the first region boundary BR1. The first region boundary line is specifically a straight line. As shown in FIG. 6, the spill plate 60 comprises a first spill plate portion 61 and a second spill plate portion 66.

The first spill plate portion 61 connects to the above described upper edge of the bucket main body portion 7. The first spill plate portion 61 is connected to the first region boundary BR1 of the bucket main body portion 7. In a top view, as shown in FIG. 6, the first spill plate portion 61 appears as a first closed region GIKLJH. This first closed region GIKLJH is surrounded by a first region boundary line KL (which is the same as the first region boundary line BL1 described above), a third left edge line IK, a second left edge line GI, a second region boundary line GH (BL2 described hereinafter), a second right edge line HJ, and a third right edge line JL. The first spill plate portion 61 includes the third left edge line IK, the second left edge line GI, the second right edge line HJ, and the third right edge line JL.

The second spill plate portion 66 is connected to the above described front edge of the first spill plate portion 61. In a top view, as shown in FIG. 6, this second spill plate portion 66 appears as a second closed region EGHF. This second closed region EGHF is surrounded by a second region boundary line GH (which corresponds to BL2 that will be described hereinafter), a first left edge line EQ a first right edge line FH, and a forward edge line EF. The second spill plate portion 66 is surrounded by the first left edge line EG, the first right edge line FH, and the forward edge line EF.

The forward edge line EF extends in the left and right directions from the front edge position of the center ML3 of the spill plate 60 in the lateral direction. In FIG. 6, a case is shown in which the forward edge line EF is a straight line that extends in the lateral direction. However, it would also be acceptable for the shape of the forward edge line EF to be some other shape, such as a zigzag line, a curve, or the like. The first front edge E is positioned to the left side of the phantom line RL1. The first front edge E is positioned to the left side of the first right end position described above. Moreover, the first front edge E is positioned to the right side of the phantom line LL2. The first front edge E is positioned to the right side of the second left end position described above. Furthermore, preferably, the first front edge E is positioned to the right side of the phantom line ML1. The first front edge E is positioned to the right side of the center position of the left boom attachment portion 40 in the lateral direction. Accordingly, at least a part of the first left edge line EG is positioned to the left side of the first right end position, and also to the right side of the second left end position.

The second front edge F is positioned to the right side of the phantom line LL1. The second front edge F is positioned to the right side of the first left end position described above. Moreover, the second front edge F is positioned to the left side of the phantom line RL2. The second front edge F is positioned to the left side of the second right end position described above. Furthermore, preferably, the second front edge F is positioned to the left side of the phantom line ML2. Accordingly, the second front edge F is positioned to the left side than the center position of the right boom attachment portion 50 in the lateral direction. Thus, at least a part of the first right edge line FH is positioned to the right side of the first left end position, and also to the left side of the second right end position.

The first left edge line EG extends rearward and leftward, or simply rearward, from the first front edge E to the first connection point G. This first left edge line EG is thus connected to the second left edge line GI at the first connection point G. A case in which the first left edge line EG is a straight line is shown in FIG. 6. However, it would also be acceptable for the shape of the first left edge line EG to be some other shape, such as a zigzag line or a curve or the like. The first right edge line FH extends rearward and rightward, or simply rearward, from the second front edge F to the second connection point H. This first right edge line FH is thus connected to the second right edge line HJ at the second connection point H. A case in which the first right edge line FH is a straight line is shown in FIG. 6. However, it would also be acceptable for the shape of the first right edge line FH to be some other shape, such as a zigzag line or a curve or the like.

The second region boundary line GH connects the first connection point G and the second connection point H. Specifically, the second region boundary line GH is a straight line. In the following explanation, the second region boundary line will be explained as being BL2. This second region boundary line BL2 indicates the front edge of the first spill plate portion 61. In FIG. 3, a second region boundary BR2 that corresponds to this second region boundary line BL1 is shown. Because the first spill plate portion 61 and the second spill plate portion 66 are formed from the same single plate, the second region boundary BR2 cannot be visually checked from the exterior. Accordingly, the second region boundary BR2 is shown by a phantom line as indicating the entire front edge of the first spill plate portion 61. Specifically, the second region boundary BR2 has a rectangular shape. In FIG. 3, each of the upper edge and the lower edge of the second region boundary BR2 is shown by a two-dot chain line. These two two-dot chain lines are separated only by the thickness of the spill plate 60. Moreover, a region boundary line that corresponds to the second region boundary BR2 is shown as BF2 in FIG. 5.

Here, referring to FIG. 6, the first connection point G is positioned to the left side of the phantom line RL1. The first connection point G is positioned to the left side of the first right end position described above. Moreover, desirably, the first connection point G is positioned to the left side of the phantom line ML1. The first connection point G is positioned to the left side of the center position of the left boom attachment portion 40 in the lateral direction. The second connection point H is positioned to the right side of the phantom line LL1. The second connection point H is positioned to the right side of the first left end position described above. Moreover, desirably, the second connection point H is positioned to the right side of the phantom line ML2. The second connection point H is positioned to the right side of the center position of the right boom attachment portion 50 in the lateral direction.

The second left edge line GI is connected to the first left edge line EG at the first connection point G. The second left edge line GI extends rearward and leftward, or simply leftward, from the first connection point G to the third connection point I. The second left edge line GI is inclined more forward than the first left edge line EG.

The second right edge line HJ is connected to the first right edge line FH at the second connection point H. The second right edge line HJ extends rearward and rightward, or simply rightward, from the second connection point H to the fourth connection point J. The second right edge line HJ is inclined more forward than the first right edge line FH.

The third left edge line IK is connected to the second left edge line GI at the third connection point I. The third left edge line IK extends rearward and leftward from the third connection point I to the point K that indicates the first upper edge UE1. The third left edge line IK is inclined more rearward than the second left edge line GI. Specifically, the third left edge line IK is the line of intersection (as defined by the ISO7546 specification etc.) of the load profile given by a slope of a grade of 50% and the plane indicated by GIKLJH.

Accordingly, the angle θ between the third left edge line IK and a straight line extending in the lateral direction (in FIG. 6, a case is shown in which the straight line KL is a straight line extending in the lateral direction) is approximately 26.57°. When the distance between the point I and the point K in the lateral direction is termed D1, then the distance D2 between the point I and the point K in the longitudinal direction is given by the following (Equation 1):

$$D2=D1\times RE \text{ (where } RE=1/2) \quad \text{(Equation 1)}$$

It should be understood that it would also be acceptable for RE to have a value other than ½. Moreover, it should be understood that the relative positional relationship between the third connection point I and the point K that indicates the first upper edge UE1 is determined in advance by the capacity and the shape of the bucket 6. Accordingly, D1 and D2 in FIG. 6 are set in advance to optimum values in accordance with the capacity and the shape of the bucket 6. Furthermore, the distance D3 between the point G and the point I in the lateral direction is also set in advance. Specifically, the distance W1 shown in FIG. 3 between G and H is set in advance in consideration of the visibility of the bucket 6 and the attachment positions of the left boom attachment portion 40 and the right boom attachment portion 50. As described above, the bucket 6 is bilaterally symmetric. Thus, the distance D3 is calculated by the following (Equation 2):

$$D3=(W0-W1-2\times D1)/2 \quad \text{(Equation 2)}$$

(W0 is the width of the bucket, and is set in advance in accordance with the size and the type of the work vehicle 1).

Accordingly, after the shape of the second left edge line GI is determined, the position of the third connection point I is consequently fixed. It should be understood that, in FIG. 6, a case is shown in which the second left edge line GI is a straight line extending in the lateral direction. However, it would also be acceptable for the shape of the second left edge line GI to be some other shape, such as a zigzag line or a curve or the like. Moreover, it would also be acceptable for the orientation of the second left edge line GI not to be along the lateral direction; it could be inclined somewhat rearward from the lateral direction. Accordingly it would also be acceptable, according to the shape and the orientation of the second left edge line GI, to arrange the first connection point G forward of the third connection point I.

The third right edge line JL is connected to the second right edge line HJ at the fourth connection point J. The third right edge line JL extends rearward and rightward from the fourth connection point J to the point L that indicates the second upper edge UE2. Specifically, the third right edge line JL is the line of intersection (as defined by the ISO7546 specification etc.) of the load profile given by a slope of a grade of 50% and the plane indicated by GIKLJH. Accordingly, the angle θ between the third right edge line JL and a straight line extending in the lateral direction (in FIG. 6, a case is shown in which the straight line KL is a straight line extending in the lateral direction) is approximately 26.57°. Here, because the bucket 6 is bilateral symmetric with respect to the phantom line ML3, accordingly the distance between the point J and the point L in the lateral direction is D1. The distance D2 between the point J and the point L in the longitudinal direction is obtained by (Equation 1) described above. It should be understood that the relative positional relationship between the fourth connection point J and the point L that indicates the second upper edge UE2 is set in advance in accordance with the capacity and the shape of the bucket 6. Accordingly, D1 and D2 in FIG. 6 are set in advance to optimum values in accordance with the capacity and the shape of the bucket 6. Furthermore, because the bucket 6 is bilaterally symmetric, accordingly the distance between the point H and the point J in the lateral direction is also D3, and is calculated by (Equation 2) described above. Accordingly, after the shape of the second right edge line HJ is determined, the position of the fourth connection point J is consequently fixed. It should be understood that, in FIG. 6, a case is shown in which the second right edge line HJ is a straight line extending in the lateral direction. However, it would also be acceptable for the shape of the second right edge line HJ to be some other shape, such as a zigzag line or a curve or the like. Moreover, it would also be acceptable for the orientation of the second right edge line HJ not to be along the lateral direction; it could be inclined somewhat rearward from the lateral direction. Accordingly it would also be acceptable, according to the shape and the orientation of the second right edge line HJ, to arrange the second connection point H forward of the fourth connection point J.

Referring to FIG. 6, the first spill plate portion 61 includes a first rear plate portion 61*a*, a first bent region BP1, and a first front plate portion 61*b*. The first bent region BP1 extends along the lateral direction. As shown in FIG. 5, the first front plate portion 61*b* is more inclined rearward and upward than the first rear plate portion 61*a*. In a similar manner, the second spill plate portion 66 includes a second rear plate portion 66*a*, a second bent region BP2, and a second front plate portion 66*b*. The second bent region BP2 extends along the lateral direction. The second front plate portion 66*b* is more inclined rearward and upward than the second rear plate portion 66*a*. Due to this, the spill plate 60 is bent along the front side surface and the bottom surface of the first side guard 70 and along the front side surface and the bottom surface of the second side guard 75.

As shown in FIGS. 4 through 6, the first side guard 70 and the second side guard 75 are adhered on the spill plate 60. To express this in more detail, the spill plate 60 is adhered to the front side surface and the bottom surface of the first side guard 70 and to the front side surface and the bottom surface of the second side guard 75. As shown in FIG. 6, in a top view, the first side guard 70 extends rearward and leftward from the front edge A of the first side guard 70 to the rear edge B thereof. Moreover, in a top view, the second side guard 75 extends rearward and rightward from the front edge C of the first side guard 75 to the rear edge D thereof.

Furthermore, in a top view, in the lateral direction, the front edge A of the first side guard 70 and the front edge C of the second side guard 75 are positioned between the first front edge E and the second front edge F. In more detail, the front edge A of the first side guard 70 is positioned to the left side of the phantom line LL3. In other words, the front edge A of the first side guard 70 is positioned to the left side of the third left end position described above. Moreover, the front edge A is positioned to the right side of the phantom line LL2. In a top view, the front edge A of the first side guard 70 is positioned to the right side of the second left end position described above. Furthermore, desirably, the front edge A of the first side guard 70 is positioned to the right side of the phantom line ML1. In a top view, the front edge A of the first side guard 70 is positioned to the right side of the center position of the left boom attachment portion 40 in the lateral direction. The front edge C of the second side guard 75 is positioned to the right side of the phantom line RL3. The front edge C of the second side guard 75 is positioned to the right side of the third right end position described above. Moreover, the front edge C of the second side guard 75 is positioned to the left side of the phantom line RL2. In a top view, the front edge C of the second side guard 75 is positioned to the left side of the second right end position described above. Yet further, desirably, the front edge C of the second side guard 75 is positioned to the left side of the phantom line ML2. The front edge C of the second side guard 75 is positioned to the left side of the center position of the right boom attachment portion 50 in the lateral direction.

Furthermore, the rear edge B of the first side guard 70 is positioned to the left side of the phantom line LL2. In other words, the rear edge B of the first side guard 70 is positioned to the left side of the second left end position described above. Furthermore, the rear edge B of the first side guard 70 is positioned rearward of the front edge of the left boom attachment portion 40. Alternatively, the rear edge B of the first side guard 70 is positioned rearward of the front edges of the second left side plate 41 and the second right side plate 42. Similarly, the rear edge D of the second side guard 75 is positioned to the right side of the phantom line RL2. The rear edge D of the second side guard 75 is positioned to the right side of the second right end position described above. Furthermore, the rear edge D of the second side guard 75 is positioned rearward of the front edge of the right boom attachment portion 50. Alternatively, the rear edge D of the second side guard 75 is positioned rearward of the front edges of the third left side plate 51 and the third right side plate 52. Accordingly, in a top view, at least a part of the first side guard 70 is positioned to the left side of the first right end position described above, and moreover to the right side of the second left end position described above. Similarly, at least a part of the second side guard 75 is positioned to the right side of the first left end position described above, and moreover to the left side of the second right end position described above.

Figure 7:
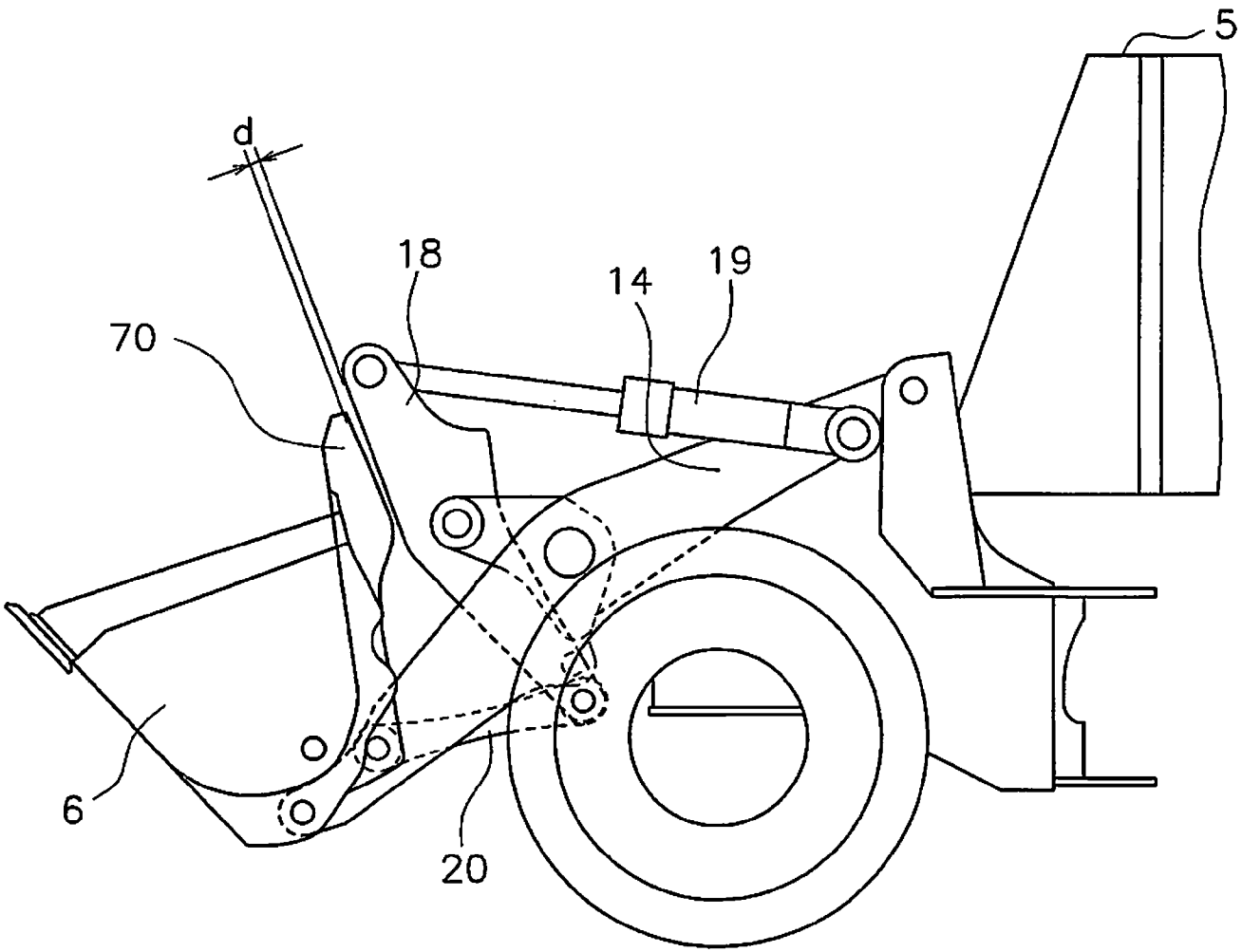
FIG. 7 is a side view showing a state in which the bucket is tilted so that the opening area of the bucket faces upward, while the work vehicle travels.

As shown in FIG. 4 and FIG. 5, the first side guard 70 and the second side guard 75 protrude upward from the spill plate 60. However, as shown in FIG. 7, the height of the first side guard 70 is limited to secure a gap of a predetermined distance d between the first side guard 70 and the tilt arm 18 even when the bucket 6 is tilted so that the opening of the bucket faces upward during traveling of the work vehicle 1. In a similar manner, the height of the second side guard 75 is limited to secure a gap of a predetermined distance d between the second side guard 75 and the tilt arm 18. Due to this, when the work vehicle is traveling, interference between the first side guard 70 and the second side guard 75, and the tilt arm 18 is hindered.

Moreover, referring to FIG. 4, as seen from the rear, the first connection point G is overlapped over the first side guard 70. Similarly, as seen from the rear, the second connection point H is overlapped over the second side guard 75. Furthermore, the first side guard 70 has a first fixing hole 71 for attachment of a hoisting hook. Similarly, the second side guard 75 has a second fixing hole 76 for attachment of a hoisting hook. The first fixing hole 71 is positioned to the left side of the phantom line LL2'. The first fixing hole 71 is positioned to the left side of the second left end position described above. The second fixing hole 76 is positioned to the right side of the phantom line RL2'. The second fixing hole 76 is positioned to the right side of the second right end position described above.

Figure 8:
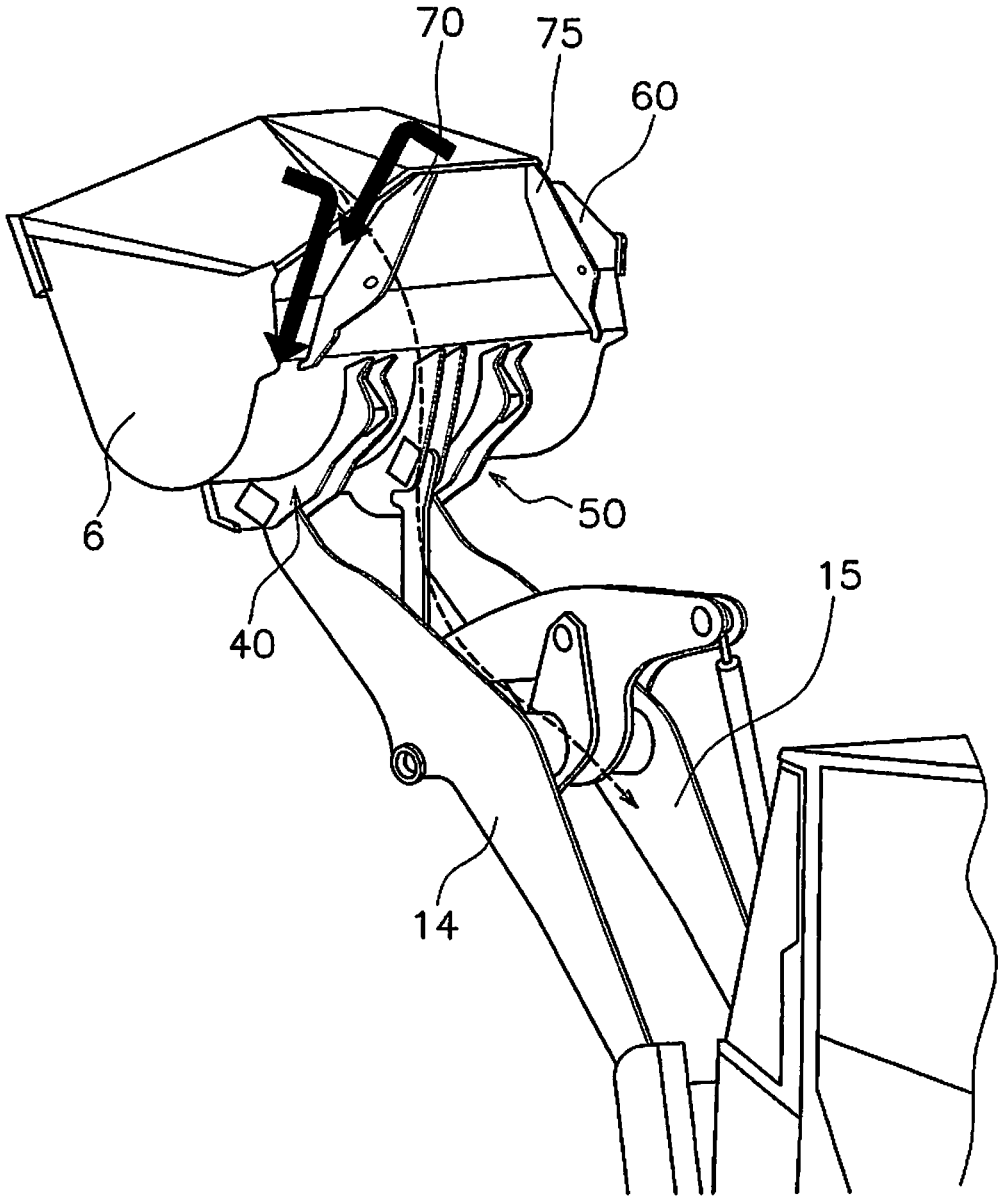
FIG. 8 is a perspective view showing the work vehicle as seen diagonally from the rear, with the bucket overloaded with the load stuff raised.

The first side guard 70, the second side guard 75, and the spill plate 60 have shapes as described above. Accordingly, as shown by the solid arrows in FIG. 8, even when the work vehicle 1 raises the bucket 6 in which an excessive amount of load stuff is loaded, the load stuff passes over the first side guard 70 and/or the second side guard 75 and falls down to the outside of the left boom attachment portion 40 and/or the right boom attachment portion 50. Therefore, the coupling provided to the left boom attachment portion 40 that links it to the left boom 14 and/or the coupling provided to the right boom attachment portion 50 that links it to the right boom 15 are protected. Furthermore, it becomes difficult for the load material to fall down onto the left boom 14 and the right boom 15. Accordingly, a fear that the front glass 5*a* of the cab 5 might be damaged due to such load stuff falling down onto the left boom 14 and/or the right boom 15 and bouncing up against the front glass 5*a* of the cab 5, as shown by the dotted arrow in FIG. 8, is reduced.

Furthermore, as shown in FIG. 9, the length W3 between the first front edge E and the second front edge F in the lateral direction is longer than the length W2 of the lower edge of the front glass 5*a* of the cab 5 in the lateral direction. Thus, because the height of the spill plate 60 becomes high in front of the front glass 5*a*, accordingly the fear that the front glass 5*a* of the cab 5 might be damaged due to load stuff falling down from the bucket 6 is further reduced.

Second Exemplary Embodiment

Figure 10:
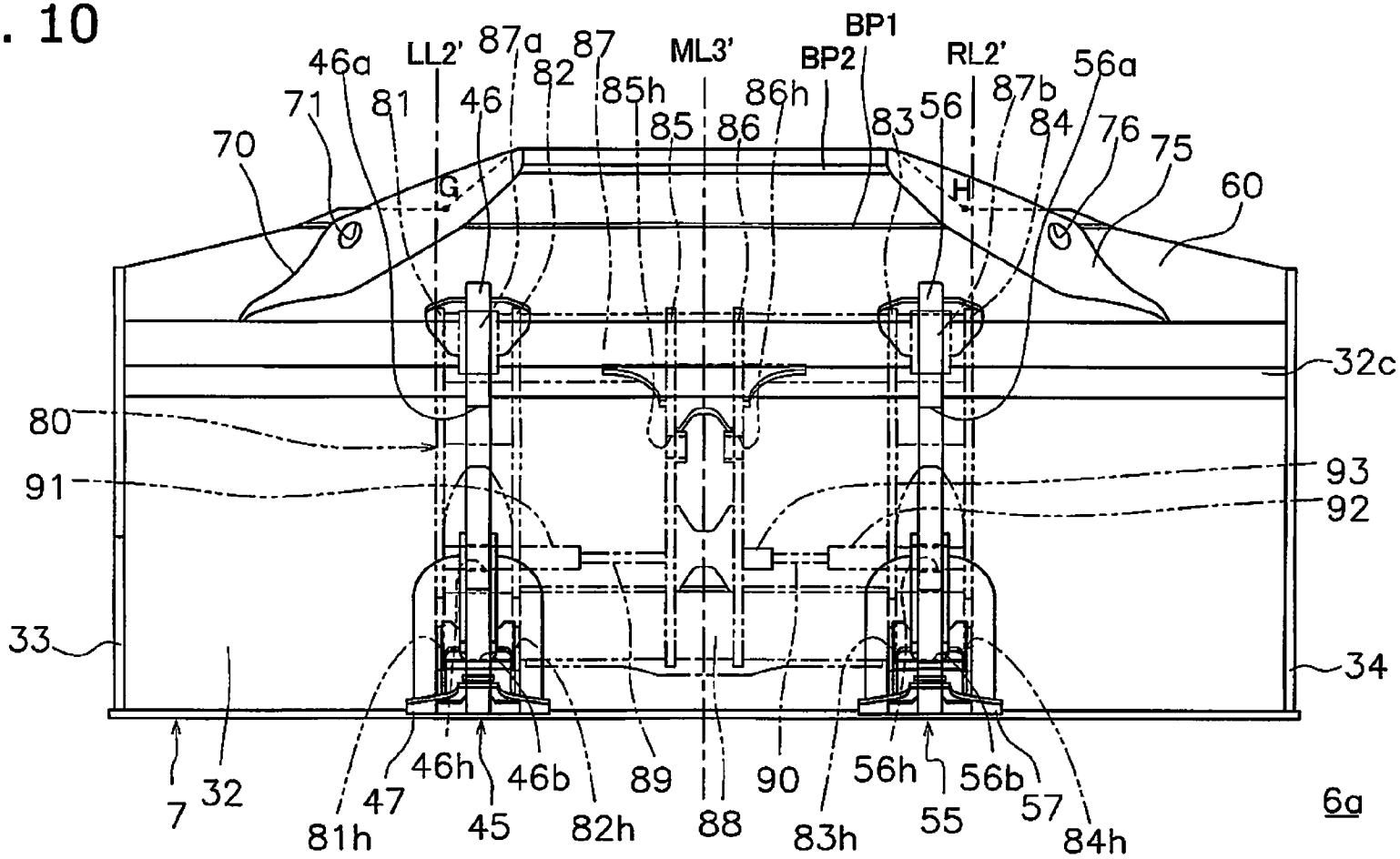
FIG. 10 is a rear view of a bucket according to a second exemplary embodiment.
Figure 11:
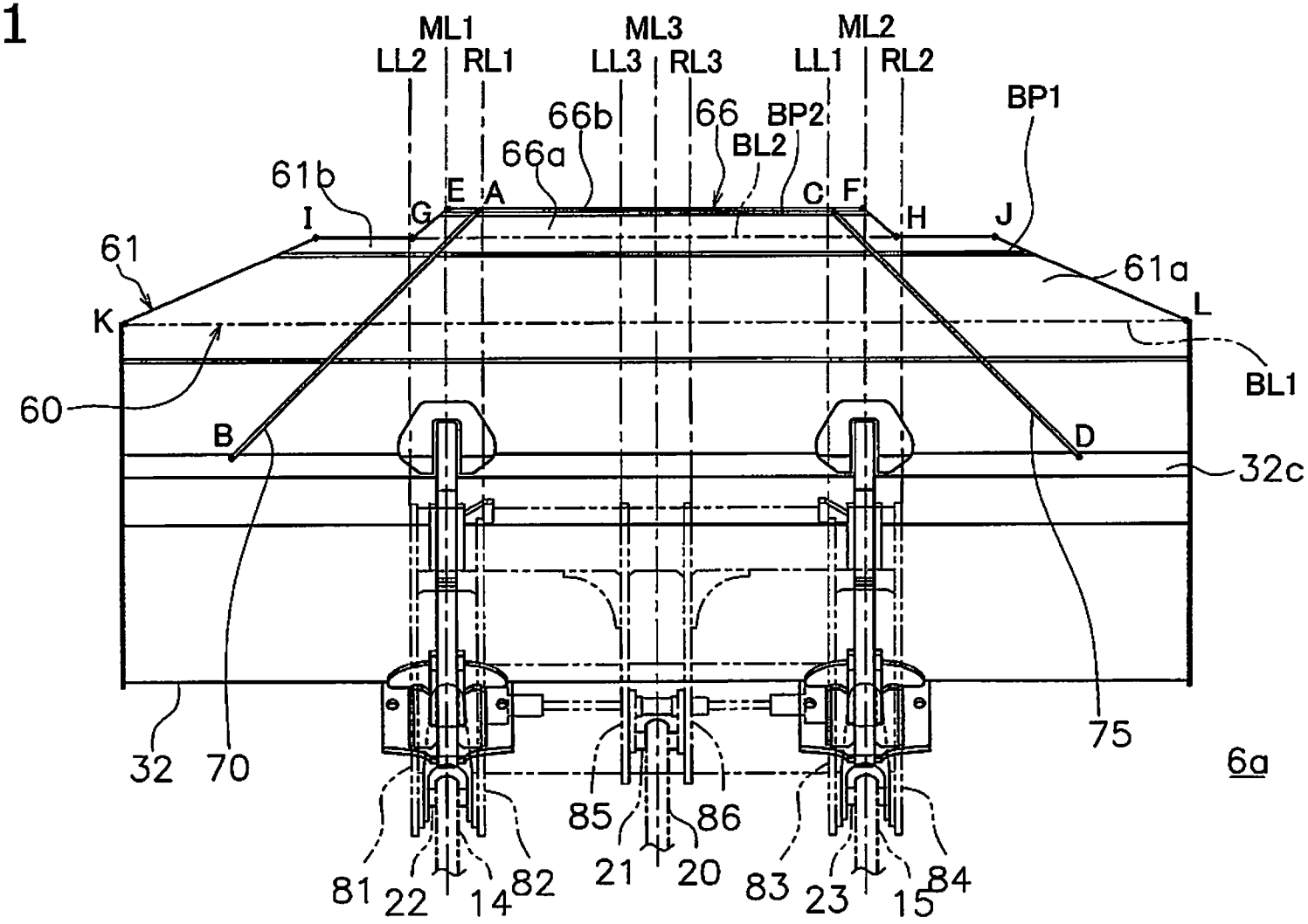
FIG. 11 is a top view of the bucket according to the second exemplary embodiment.
Figure 12:
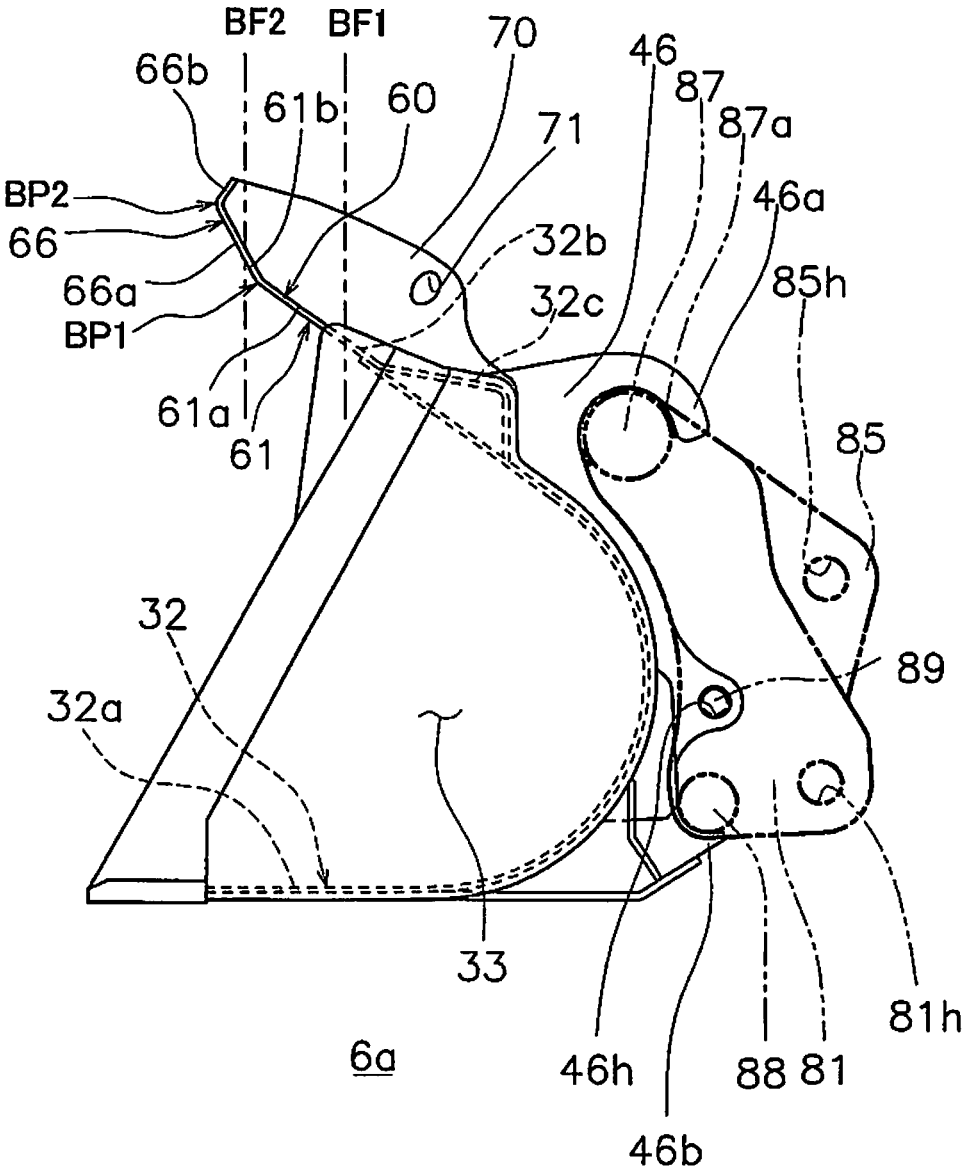
FIG. 12 is a left side view of the bucket according to the second exemplary embodiment.

In the first exemplary embodiment, a case is explained in which the bucket 6 is a normal bucket which is installed to a work vehicle 1 by performing manual operation. However, the present invention can also be applied to a bucket that is installed to a work vehicle 1 that comprises a linking mechanism (i.e. a coupler) by which a working implement attachment is mechanically installed. In the following, such bucket is referred to as a bucket 6*a* according to the second exemplary embodiment of the present invention and is explained with reference to FIGS. 10 through 12. FIG. 10 is a back view of the bucket 6*a*. FIG. 11 is a top view of the bucket 6*a*. FIG. 12 is a left side view of the bucket 6*a*. Most of the structure of the bucket 6*a* is the same as that of the bucket 6. Accordingly, in FIGS. 10 through 12, to features of the bucket 6*a* that are the same, the same reference symbols are appended. In the explanation given below, characteristics of the bucket 6*a* that are not mentioned are the same as those of the bucket 6. It should be understood that in FIGS. 10 through 12, structures related to a coupler 80 are shown by two-dot chain lines, for convenience of explanation.

A left boom attachment portion 45 of the bucket 6*a* does not include the second left side plate 41, the second right side plate 42, and the rib 43 of the left boom attachment portion 40 of the bucket 6. Instead, the left boom attachment portion 45 includes a left engagement bracket 46 that extends in the vertical direction and a left bottom portion member 47 that is adhered to the lower edge of the left engagement bracket 46. Similarly, a right boom attachment portion 55 of the bucket 6*a* does not include the third left side plate 51, the third right side plate 52, and the rib 53 of the right boom attachment portion 50 of the bucket 6. Instead, the right boom attachment portion 55 includes a right engagement bracket 56 that extends in the vertical direction and a right bottom portion member 57 that is adhered to the lower edge of the right engagement bracket 56. As shown in FIG. 11 and FIG. 12, with this bucket 6*a*, the left boom attachment portion 45 and the right boom attachment portion 55 are mutually symmetric, because the bucket 6*a* is approximately bilateral symmetric with respect to the phantom lines ML3 and ML3' that indicate the center position of the bucket 6*a* in the lateral direction. The left engagement bracket 46, the left bottom portion member 47, the right engagement bracket 56, and the right bottom portion member 57 are attached to the basal plate 32 by welding. The left engagement bracket 46 and the right engagement bracket 56 are flat members that extend in the vertical direction. As shown in FIGS. 10 through 12, the left engagement bracket 46 and the right engagement bracket 56 extend forward along the curved basal plate 328 toward the upper edge.

Referring to FIG. 10 and FIG. 12, the left engagement bracket 46 includes a left hook portion 46*a*, a left engagement hole 46*h*, and a left coupler support portion 46*b*. The left hook portion 46*a* has the shape of a letter-U that is opened at the lower side. A left engagement pin 89 of the coupler 80, which will be described hereinafter, is passed through the left engagement hole 46*h*. Referring to FIG. 12, the left engagement hole 46*h* is disposed below the left hook portion 46*a*, and moreover above the left coupler support portion 46*b*. The left coupler support portion 46*b* supports the coupler 80 from below. Referring to FIG. 10, the right engagement bracket 56 includes a right hook portion 56*a*, a right engagement hole 56*h*, and a right coupler support portion 56*b*. The right hook portion 56*a*, the right engagement hole 56*h*, and the right coupler support portion 56*b* are respectively symmetric with the left hook portion 46*a*, the left engagement hole 46*h*, and the left coupler support portion 46*b* with respect to the phantom lines ML3 and ML3' which indicate the center position of the bucket 6*a* in the lateral direction.

Referring to FIG. 10, the coupler 80 includes a first left frame 81, a first right frame 82, a second left frame 83, a second right frame 84, a third left frame 85, a third right frame 86, an upper beam portion 87, a left hook engagement portion 87*a*, a right hook engagement portion 87*b*, a lower beam portion 88, a left engagement pin 89, a right engagement pin 90, a left pin boss 91, a right pin boss 92, and a center pin boss 93. The first left frame 81, the first right frame 82, the second left frame 83, the second right frame 84, the third left frame 85, and the third right frame 86 are flat members that extend in the vertical direction. As shown in FIGS. 10 through 12, the first left frame 81, the first right frame 82, the second left frame 83, the second right frame 84, the third left frame 85, and the third right frame 86 extend forward along the curved basal plate 32 toward the upper edge.

The upper edge portions of the first left frame 81, the first right frame 82, the second left frame 83, the second right frame 84, the third left frame 85, and the third right frame 86 are attached to the upper beam portion 87 by welding. The lower edge portions of the first left frame 81, the first right frame 82, the second left frame 83, the second right frame 84, the third left frame 85, and the third right frame 86 are attached to the lower beam portion 88 by welding. The first left frame 81 and the first right frame 82 have respective rotation shaft fitting holes 81*h* and 82*h* that rotatably support the rotation shaft 22 of the left boom 14. Here, the rotation shaft 22 and the rotation shaft fitting holes 81*h* and 82*h* will collectively be referred to as the coupling of the left boom 14. Similarly, the second left frame 83 and the second right frame 84 have respective rotation shaft fitting holes 83*h* and 84*h* that rotatably support the rotation shaft 23 of the right boom 15. Here, the rotation shaft 23 and the rotation shaft fitting holes 83*h* and 84*h* will collectively be referred to as the coupling of the right boom 15. Moreover, the third left frame 85 and the third right frame 86 have respective rotation shaft fitting holes 85*h* and 86*h* for rotatably supporting the rotation shaft 21 of the tilt rod 20. A left hook engagement portion 87*a* for the left hook portion 46*a* to be hooked into is provided above the upper beam portion 87 between the first left frame 81 and the first right frame 82. Moreover, a right hook engagement portion 87*b* for the right hook portion 56*a* to be hooked into is provided above the upper beam portion 87 between the second left frame 83 and the second right frame 84.

The left pin boss 91 supports the left engagement pin 89 to freely move back and forth in the lateral direction, and is welded somewhat below the center between the first left frame 81 and the first right frame 82 in the longitudinal direction. Through holes through which the left engagement pin 89 can pass are provided in the first left frame 81 and the first right frame 82. The left engagement pin 89 can also pass through the left engagement hole 46*h* described above. Similarly, the right pin boss 92 that supports the right engagement pin 90 so as to freely move back and forth in the lateral direction, is welded somewhat below the center between the second left frame 83 and the second right frame 84 in the longitudinal direction. Through holes through which the right engagement pin 90 can pass are provided in the second left frame 83 and the second right frame 84. The right engagement pin 90 can also pass through the right engagement hole 56*h* described above. Moreover, the center pin boss 93 that supports the left engagement pin 89 and the right engagement pin 90 to freely move back and forth in the lateral direction, and is welded somewhat below the center in the longitudinal direction of the third right frame 86. Thus, the two end portions of the left engagement pin 89 are slidably supported by the left pin boss 91 and the center pin boss 93. Moreover, the two end portions of the right engagement pin 90 are slidably supported by the right pin boss 92 and the center pin boss 93. The left engagement pin 89 and the right engagement pin 90 are shifted in the lateral direction by a pin drive mechanism not shown in the figures (for example, by actuators).

As shown in FIG. 12, when the coupler 80 is engaged to the bucket 6*a*, the positions and orientations of the booms 14 and 15 and of the tilt rod 20 are adjusted, and the left hook engagement portion 87*a* and the right hook engagement portion 87*b* are respectively hooked onto the left hook portion 46*a* and onto the right hook portion 56*a*. The lower beam portion 88 is pressed against the left coupler support portion 46*b* and the right coupler support portion 56*b*. Finally, the left engagement pin 89 and the right engagement pin 90 are respectively passed through the left engagement hole 46*a* and the right engagement hole 56*h*. At this time, the front surface of the third left frame 85 and the front surface of the third right frame 86 are contacted against the rear surface of the basal plate 32.

In this state, the position of the left side of the first left frame 81 corresponds to the left end position of the coupling connecting the left boom 14 to the left boom attachment portion 45 when the left boom 14 is attached to the left boom attachment portion 45, i.e. the second left end position described above. In FIG. 11, a phantom line passing through this second left end position and extending in the longitudinal direction is shown as a chain line LL2. In FIG. 10, a phantom line passing through the second left end position and extending in the vertical direction is shown as a chain line LL2'. Moreover, the position of the right side of the first right frame 82 corresponds to the right end position of the coupling connecting the left boom 14 to the left boom attachment portion 45 when the left boom 14 is attached to the left boom attachment portion 45, i.e. the first right end position described above. In FIG. 11, a phantom line passing through the first right end position and extending in the longitudinal direction is shown as a chain line RL1. Furthermore FIG. 11 shows a phantom line passing through the center position of the left boom 14 in the lateral direction when the left boom 14 is attached to the left boom attachment portion 45, the phantom line extending in the longitudinal direction as a chain line ML1. This phantom line ML1 passes exactly in the middle between the phantom line LL2 and the phantom line RL1. Thus, the phantom line ML1 passes through the center in the lateral direction of the left engagement bracket 46. The phantom line ML1 corresponds to the center position in the lateral direction of the left boom attachment portion 45. Alternatively, the left engagement bracket 46 is bilaterally symmetric with respect to the phantom line ML1.

Moreover, the position of the left side of the second left frame 83 corresponds to the left end position of the coupling connecting the right boom 15 to the right boom attachment portion 55 when the right boom 15 is attached to the right boom attachment portion 55, i.e. the first left end position described above. In FIG. 11, a phantom line passing through the first left end position and extending in the longitudinal direction is shown as a chain line LL1. The position of the right side of the second left frame 84 corresponds to the right end position of the coupling connecting the right boom 15 to the right boom attachment portion 55 when the right boom 15 is attached to the right boom attachment portion 55, i.e. the second right end position described above. In FIG. 11, a phantom line passing through the second right end position and extending in the longitudinal direction is shown as a chain line RL2. Also, in FIG. 10, a phantom line passing through the second right end position and extending in the vertical direction is shown as a chain line RL2'. Moreover, FIG. 11 shows a phantom line extending in the longitudinal direction and passing through the center position of the right boom 15 in the lateral direction when the right boom 15 is attached to the right boom attachment portion 55 as a chain line ML2. This phantom line ML2 passes exactly in the middle between the phantom line LL1 and the phantom line RL2. Thus, the phantom line ML2 passes through the center of the right engagement bracket 56 in the lateral direction. In other words, the phantom line ML2 corresponds to the center position of the right boom attachment portion 55 in the lateral direction. Alternatively, the right engagement bracket 56 is bilaterally symmetric with respect to the phantom line ML2.

The position of the left side of the third left frame 85 corresponds to the left end position of the coupling that links to the tilt rod 20 when the tilt rod 20 is attached to the third left frame 85 and to the third right frame 86, i.e. the third left end position described above. In FIG. 11, a phantom line that passes through the third left end position and extends in the longitudinal direction is shown as a chain line LL3. Moreover, the position of the right side of the third right frame 86 corresponds to the right end position of the coupling that links to the tilt rod 20 when the tilt rod 20 is attached to the third left frame 85 and to the third right frame 86, i.e. the third right end position described above. In FIG. 11, a phantom line that passes through this third right end position and extends in the longitudinal direction is shown as a chain line RL3. Moreover FIG. 11 shows a phantom line extending in the longitudinal direction and passing through the center position of the tilt rod 20 in the lateral direction when the tilt rod 20 is attached to the third left frame 85 and to the third right frame 86 as a chain line ML3. This phantom line ML3 passes exactly in the middle between the phantom line LL3 and the phantom line RL3. In FIG. 10, a phantom line passing through the center position of the tilt rod 20 in the lateral direction when the tilt rod 20 is attached to the third left frame 85 and to the third right frame 86, the phantom line extending in the vertical direction is shown as a chain line ML3'. The phantom lines ML3 and ML3' correspond to the center position of the bucket 6*a* in the lateral direction.

When FIG. 4 and FIG. 10 are compared together, it will be understood that, in this second exemplary embodiment, the positional relationships of the first fixing hole 71 of the first side guard 70, the second fixing hole 76 of the second side guard 75, and the phantom lines LL2' and RL2' are the same as their positional relationships in the first exemplary embodiment. Furthermore, the fact that the first connection point G is overlapped over the first side guard 70 as seen from the rear, and the fact that the second connection point H is overlapped over the second side guard 75 as seen from the rear, are also the same.

Yet further, when FIG. 6 and FIG. 11 are compared together, it will be understood that, in this second exemplary embodiment, the positional relationships of the points A, B, C, D, E, F, G, H, I, J, K and L and the phantom lines LL1, LL2, LL3, RL1, RL2, RL3, ML1, ML2 and ML3 are the same as their positional relationships in the first exemplary embodiment. Moreover, the method of determining the points K, I, L, and J is also the same as the method of determination in the first exemplary embodiment. Furthermore, the slopes of the first side guard 70 and of the second side guard 75, the fact that at least a part of the first side guard 70 is between the phantom line LL2 and the phantom line RL1, and the fact that at least a part of the second side guard 75 is between the phantom line LL2 and the phantom line RL1, are also the same as in the first exemplary embodiment. Accordingly, the characteristics and the advantageous effects of the bucket 6*a* according to the second exemplary embodiment are the same as those of the bucket 6 of the first exemplary embodiment.

The distinguishing characteristics of the buckets 6 and 6*a* according to the exemplary embodiments described above and of the work vehicles 1 to which these buckets are mounted are as follows.

Portions inside the spill plate 60 are cut out by the first left edge line EQ the second left edge line GI and the third left edge line IK, as well as by the first right edge line FH, the second right edge line HJ, and the third right edge line JL. Accordingly, it is possible to ensure the width of the field of vision. Moreover, the spill plate 60 is built in at least two stages, including the first spill plate portion 61 and the second spill plate portion 66. Accordingly it is possible to form the large spill plate 60, while still ensuring the wide visibility. The first connection point G is positioned to the left side of the first right end position RL1 of the left boom attachment portion 40, while moreover the second connection point H is positioned to the right side of the first left end position LL1 of the right boom attachment portion 50. Accordingly, it is possible to hinder load stuff that passes over the spill plate 60 from falling down upon the couplings of the left and right booms 14 and 15 that support the bucket 6, 6*a*. As a result, it is possible to protect the couplings of the left and right booms 14 and 15 that support the bucket 6, 6*a* and the front glass of the cab 5 from load stuff falling down from the bucket 6, 6*a*, while still ensuring the visibility of the bucket 6, 6*a*.

The first connection point G is positioned to the left side of the center position (i.e. the phantom line ML1) of the left boom attachment portions 40 and 45 in the lateral direction, while moreover the second connection point H is positioned to the right side of the center position (i.e. the phantom line ML2) of the right boom attachment portions 50 and 55 in the lateral direction. Accordingly, it is possible for the cutout portions of the spill plate 60 to be provided further to the outer sides of the spill plate 60. Therefore, it becomes more difficult for load stuff to fall down upon the couplings of the left and right booms 14 and 15 that support the bucket 6, 6*a*.

The first front edge E is positioned to the left side of the first right end position (i.e. the phantom line RL1). The second front edge F is positioned to the right side of the first left end position (i.e. the phantom line LL1). Accordingly, the portion where the longitudinal length of the spill plate 60 is longest is provided to the left side of the first right end position, and moreover to the right side of the first left end position. Accordingly, it is more difficult for load stuff to fall down upon the couplings of the left and right booms 14 and 15 that support the bucket 6, 6*a*.

At least a part of the first left edge line EG is positioned to the left side of the first right end position (i.e., the phantom line RL1), and moreover to the right side of the second left end position (i.e., the phantom line LL2). And at least a part of the first right edge line FH is positioned to the right side of the first left end position (i.e., the phantom line LL1), and moreover to the left side of the second right end position (i.e., the phantom line RL2). Furthermore, the first front edge E is positioned to the right side of the second left end position (i.e., the phantom line LL2), and the second front edge F is positioned to the left side of the second right end position (i.e., the phantom line RL2). Accordingly, the portion where the longitudinal length of the spill plate 60 is longest is provided to the left side of the first right end position and moreover to the right side of the second left end position, and also to the right side of the first left end position and moreover to the left side of the second right end position. Therefore, it is possible sufficiently to ensure the field of vision in the vicinity of the left and right ends of the bucket 6, 6*a*.

The first front edge E is positioned to the right side of the center position (i.e., the phantom line ML1) of the left boom attachment portions 40 and 45 in the lateral direction. The second front edge F is positioned to the left side of the center position (i.e., the phantom line ML2) of the right boom attachment portions 50 and 55 in the lateral direction. Accordingly, it is possible further to ensure the wide visibility in the vicinity of the left and right ends of the bucket 6, 6*a*.

As viewed from the rear, the first connection point G is overlapped over the first side guard 70. Moreover, as viewed from the rear, the second connection point H is overlapped over the second side guard 75. Accordingly, the first side guard 70 and the second side guard 75 obstruct load stuff that passes near the first connection point G and the second connection point H and falls down. Accordingly, it is yet more difficult for load stuff to fall down upon the couplings of the left and right booms 14 and 15 that support the bucket 6, 6*a*.

In a top view, the first side guard 70 extends rearward and leftward from the front edge A of the first side guard 70. In a top view, the second side guard 75 extends rearward and rightward from the front edge C of the second side guard 75. As a result, load stuff that falls down upon the first side guard 70 and the second side guard 75 is discharged toward the outsides of the bucket 6, 6*a*.

In a top view, the front edge A of the first side guard 70 is positioned to the right side of the center position (i.e. the phantom line ML1) in the lateral direction of the left boom attachment portions 40 and 45. In a top view, the front edge C of the second side guard 75 is positioned to the left side of the center position (i.e. the phantom line ML2) of the right boom attachment portions 50 and 55 in the lateral direction. Accordingly, the second side guard 75 is provided rearward of a great portion of the cutout portion of the spill plate 60. Thus, it becomes yet more difficult for load stuff to fall down upon the couplings of the left and right booms 14 and 15 that support the bucket 6, 6*a*.

In a top view, the front edge A of the first side guard 70 and the front edge C of the second side guard 75 are positioned, in the lateral direction, between the first front edge E and the second front edge F. Accordingly, the second side guard 75 is provided rearward of the cutout portion in the vicinity of the center of the spill plate 60. Accordingly, it becomes yet more difficult for load stuff to fall down upon the couplings of the left and right booms 14 and 15 that support the bucket 6, 6*a*.

The rear edge B of the first side guard 70 is positioned to the left side of the second left end position (i.e., the phantom line LL2). The rear edge D of the second side guard 75 is positioned to the right side of the second right end position (i.e. the phantom line RL2). Accordingly, load stuff that falls down upon the first side guard 70 and the second side guard 75 is discharged toward the outsides of the couplings of the left and right booms 14 and 15 that support the bucket 6, 6*a*.

At least one of the first side guard 70 and the second side guard 75 has a fixing hole 71 or 76 for attachment of a hoisting hook. Accordingly, the tasks of attaching and removing the bucket 6, 6*a* become simple and easy.

The first fixing hole 71 is positioned to the left side of the second left end position (i.e., the phantom line LL2). The second fixing hole 76 is positioned to the right side of the second right end position (i.e. the phantom line RL2). Accordingly, it is difficult for load stuff that passes through the first fixing hole 71 and the second fixing hole 76 to fall down upon the couplings of the left and right booms 14 and 15 that support the bucket 6, 6*a*.

The spill plate 60 is bent along the forward surface and the bottom surface of the first side guard 70, and along the forward surface and the bottom surface of the second side guard 75. Due to this, it is possible to enhance the rigidity of the spill plate 60. Furthermore, because the first side guard 70 and the second side guard 75 fulfill the role of ribs, accordingly bending of the spill plate 60 is hindered, even when further pressure is applied to the front edge portion of the spill plate 60.

The spill plate 60 is formed from a single plate. Due to this, it is possible to enhance the rigidity of the spill plate.

The length W3 in the lateral direction between the first front edge E and the second front edge F of the spill plate 60 is longer than the length W2 in the lateral direction of the lower edge of the front glass 5*a* of the cab 5. Thus, because the height of the spill plate 60 becomes high in front of the front glass 5*a*, accordingly the fear of the front glass 5*a* becoming damaged due to load stuff falling down from the bucket 6 is reduced.

While exemplary embodiments of the present invention have been explained above, the present invention is not to be considered as being limited to those embodiments described above; various changes can be made to the range of the present invention, provided that the essence of the present invention is not departed from.

The form of the bucket main body portion 7 is not limited to the examples disclosed in the above exemplary embodiments. For example, different form of the cutting edge 31, different form of the bottom plate 32, and different forms of the side plates 33 and 34 are applicable. Moreover, if the positions and/or the forms of the tilt rod attachment portion 35, the left boom attachment portions 40 and 45, or the right boom attachment portions 50 and 55 are different, the positions and/or the forms of the spill plate 60, of the first side guard 70, and of the second side guard 75 are determined according to the positions and/or the shapes of the coupling to which the tilt rod 20 is connected, of the coupling to which the left boom 14 is connected, and of the coupling to which the right boom 15 is connected, as in the exemplary embodiments described above.

While, in the exemplary embodiments described above, cases are shown in which the first region boundary line BL1 and the second region boundary line BL1 are straight lines, the shapes of these boundary lines could also be other shapes, such as zigzag lines, curves, or the like.

The form of the coupler 80 according to the second exemplary embodiment is only given as an example; other forms would also be acceptable. Even in the case of some different form, the coupler would still include a coupling to which the tilt rod 20 is connected, a coupling to which the left boom 14 is connected, and a coupling to which the right boom 15 is connected. Accordingly, the positions and/or the forms of the spill plate 60, of the first side guard 70, and of the second side guard 75 of the bucket 6*a* may be determined based on the positions and/or the forms of the joint constructions of the coupler, as in the second exemplary embodiment.

According to the present invention, it is possible to protect the couplings of the left and right booms that support the bucket from the load stuff falling down from the bucket, while still ensuring the visibility of the bucket.

The invention claimed is:

1. A bucket for a work vehicle, comprising:

a bucket main body portion including a basal plate having a curved shape, and a left side plate and a right side plate, the left side plate and the right side plate being adhered to the basal plate;

a left boom attachment portion adhered to the rear surface of the basal plate, to the left side of the center of the basal plate in the lateral direction;

a right boom attachment portion adhered to the rear surface of the basal plate, to the right side of the center of the basal plate in the lateral direction; and a spill plate including a first spill plate portion connected to the upper edge of the bucket main body portion, and a second spill plate portion connected to the front edge of the first spill plate portion, wherein, in a top view, the second spill plate portion includes a forward edge line extending in the right and left directions from a center of the bucket main body portion in the lateral direction;

a first left edge line extending rearward and leftward to a first connection point from a first front end, the first front end being a left end of the forward edge line; and a first right edge line extending rearward and rightward to a second connection point from a second front end, the second front end being a right end of the forward edge line, wherein, in the top view, the first spill plate portion includes a second left edge line connected to the first left edge line at the first connection point, the second left edge line extending rearward and leftward, or leftward, from the first connection point to a third connection point;

a second right edge line connected to the first right edge line at the second connection point, the second right edge line extending rearward and rightward, or rightward, from the second connection point to a fourth connection point;

a third left edge line connected to the second left edge line at the third connection point, the third left edge line extending rearward and leftward from the third connection point, the third left edge line inclining more rearward than the second left edge line; and a third right edge line connected to the second right edge line at the fourth connection point, the third right edge line extending rearward and rightward from the fourth connection point, the third right edge line inclining more rearward than the second right edge line, wherein the first connection point is positioned to the left side of a first right end position, the first right end position being a right end position of the left boom attachment portion, wherein the second connection point is positioned to the right side of a first left end position, the first left end position being a left end position of the right boom attachment portion, wherein at least a part of the first left edge line is positioned to the left side of the first right end position and to the right side of a second left end position, the second left end position being a left end position of the left boom attachment portion, and at least a part of the first right edge line is positioned to the right side of the first left end position and to the left side of a second right end position, the second right end position being a right end position of the right boom attachment portion.

2. A bucket for a work vehicle according to claim 1, wherein the first connection point is positioned to the left side of the center position in the lateral direction of the left boom attachment portion, and the second connection point is positioned to the right side of the center position in the lateral direction of the right boom attachment portion.

3. A bucket for a work vehicle according to claim 1, wherein the first front end is positioned to the left side of the first right end position, and the second front end is positioned to the right side of the first left end position.

4. A work vehicle, comprising:

a bucket for the work vehicle according to claim 1;

the left boom and the right boom, the left boom and the right boom being fitted to the bucket for a work vehicle;

a first hydraulic cylinder controlling the left boom;

a second hydraulic cylinder controlling the right boom; and a cab disposed behind the left boom and the right boom, wherein a front glass is provided in a front surface of the cab, and the length between the first front end and the second front end in the lateral direction is longer than the length of the bottom edge of the front glass in the lateral direction.

5. A bucket for a work vehicle according to claim 1, wherein the first front end is positioned to the right side of the second left end position, and the second front end is positioned to the left side of the second right end position.

6. A bucket for a work vehicle according to claim 5, wherein the first front end is positioned to the right side of the center position of the left boom attachment portion in the lateral direction, and the second front end is positioned to the left side of the center position of the right boom attachment portion in the lateral direction.

7. A bucket for a work vehicle according to claim 1, further comprising a first side guard and a second side guard, the first side guard and the second side guard being adhered to the spill plate, and wherein as seen from the rear, the first connection point is overlapped over the first side guard, and as seen from the rear, the second connection point is overlapped over the second side guard.

8. A bucket for a work vehicle according to claim 7, wherein in the top view, the first side guard extends rearward and leftward from the front edge of the first side guard, and in the top view, the second side guard extends rearward and rightward from the front edge of the second side guard.

9. A bucket for a work vehicle according to claim 8, wherein in the top view, the front edge of the first side guard is positioned to the right side of the center position of the left boom attachment portion in the lateral direction, and in the top view, the front edge of the second side guard is positioned to the left side of the center position of the right boom attachment portion in the lateral direction.

10. A bucket for a work vehicle according to claim 8, wherein, in the top view, the front edge of the first side guard and the front edge of the second side guard are positioned between the first front end and the second front end in the lateral direction.

11. A bucket for a work vehicle according to claim 8, wherein the rear edge of the first side guard is positioned to the left side of a second left end position, the second left end position being a left end position of the left boom attachment portion, and the rear edge of the second side guard is positioned to the right side of a second right end position, the second right end position being a right end position of the right boom attachment portion.

12. A bucket for a work vehicle according to claim 11, wherein the first side guard includes a first fixing hole for attachment of a hoisting hook.

13. A bucket for a work vehicle according to claim 12, wherein the first fixing hole is positioned to the left side of the second left end position.

14. A bucket for a work vehicle according to claim 11, wherein the second side guard includes a second fixing hole for attachment of a hoisting hook.

15. A bucket for a work vehicle according to claim 14, wherein the second fixing hole is positioned to the right side of the second right end position.

16. A bucket for a work vehicle according to claim 7, wherein the spill plate is bent along a forward side surface and the bottom surface of the first side guard and along the forward side surface and the bottom surface of the second side guard.

17. A bucket for a work vehicle according to claim 16, wherein the spill plate is formed from a single plate.

18. A bucket for a work vehicle according to claim 1, wherein, in the top view, the second left edge line and the second right edge line are straight lines extending in the lateral direction.

19. A bucket for a work vehicle according to claim 18, wherein the first left edge line, the first right edge line, the third left edge line, and the third right edge line are straight lines.

20. A bucket for a work vehicle, comprising:

a bucket main body portion including a basal plate having a curved shape, and a left side plate and a right side plate, the left side plate and the right side plate being adhered to the basal plate;

a left boom attachment portion adhered to the rear surface of the basal plate, to the left side of the center of the basal plate in the lateral direction;

a right boom attachment portion adhered to the rear surface of the basal plate, to the right side of the center of the basal plate in the lateral direction;

a spill plate including a first spill plate portion connected to the upper edge of the bucket main body portion, and a second spill plate portion connected to the front edge of the first spill plate portion; and a first side guard and a second side guard, the first side guard and the second side guard being adhered to the spill plate, wherein, in a top view, the second spill plate portion includes a forward edge line extending in the right and left directions from a center of the bucket main body portion in the lateral direction;

a first left edge line extending rearward and leftward to a first connection point from a first front end, the first front end being a left end of the forward edge line; and a first right edge line extending rearward and rightward to a second connection point from a second front end, the second front end being a right end of the forward edge line, wherein, in the top view, the first spill plate portion includes a second left edge line connected to the first left edge line at the first connection point, the second left edge line extending rearward and leftward, or leftward, from the first connection point to a third connection point;

a second right edge line connected to the first right edge line at the second connection point, the second right edge line extending rearward and rightward, or rightward, from the second connection point to a fourth connection point;

a third left edge line connected to the second left edge line at the third connection point, the third left edge line extending rearward and leftward from the third connection point, the third left edge line inclining more rearward than the second left edge line; and a third right edge line connected to the second right edge line at the fourth connection point, the third right edge line extending rearward and rightward from the fourth connection point, the third right edge line inclining more rearward than the second right edge line, wherein the first connection point is positioned to the left side of a first right end position, the first right end position being a right end position of the left boom attachment portion, wherein the second connection point is positioned to the right side of a first left end position, the first left end position being a left end position of the right boom attachment portion, wherein the spill plate is bent along the forward side surface and the bottom surface of the first side guard and along the forward side surface and the bottom surface of the second side guard, wherein at least a part of the first left edge line is positioned to the left side of the first right end position and to the right side of a second left end position, the second left end position being a left end position of the left boom attachment portion, and at least a part of the first right edge line is positioned to the right side of the first left end position and to the left side of a second right end position, the second right end position being a right end position of the right boom attachment portion.

* * * * *